US009004483B2

(12) United States Patent
Minamisawa

(10) Patent No.: US 9,004,483 B2
(45) Date of Patent: Apr. 14, 2015

(54) IMAGE FORMING SYSTEM AND SHEET TRANSPORT APPARATUS AND METHOD

(71) Applicant: Fuji Xerox Co., Ltd., Minato-ku, Tokyo (JP)

(72) Inventor: Yoshihiko Minamisawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/774,514

(22) Filed: Feb. 22, 2013

(65) Prior Publication Data

US 2014/0015189 A1 Jan. 16, 2014

(30) Foreign Application Priority Data

Jul. 11, 2012 (JP) ..... 2012-156005

(51) Int. Cl.

| | |
|---|---|
| ***B65H 29/00*** | (2006.01) |
| ***B65H 39/10*** | (2006.01) |
| ***B65H 33/04*** | (2006.01) |
| ***B65H 43/02*** | (2006.01) |

(52) U.S. Cl.

CPC ..... *B65H 29/00* (2013.01); *B65H 33/04* (2013.01); *B65H 39/10* (2013.01); *B65H 43/02* (2013.01); *B65H 2220/02* (2013.01); *B65H 2301/4318* (2013.01); *B65H 2511/51* (2013.01); *B65H 2511/52* (2013.01); *B65H 2511/528* (2013.01); *B65H 2513/50* (2013.01); *B65H 2801/06* (2013.01); *B65H 2301/4452* (2013.01)

(58) Field of Classification Search

CPC ..... B65H 3/04; B65H 2513/20; B65H 2301/4454; B65H 2801/27; B65H 29/00; B65H 2313/20; G03G 15/655

USPC ..... 271/9.11, 9.12, 9.13, 9.04; 270/58.01, 270/59, 58.02, 58.23, 58.25, 58.31, 58.32

See application file for complete search history.

(56) References Cited

U.S. PATENT DOCUMENTS

| | | | | |
|---|---|---|---|---|
| 4,589,765 | A * | 5/1986 | Perun et al. | 399/21 |
| 4,785,329 | A * | 11/1988 | Walsh | 399/11 |
| 7,113,846 | B2 * | 9/2006 | Moriyama et al. | 700/223 |
| 7,651,081 | B2 * | 1/2010 | Yokobori et al. | 270/58.23 |
| 7,869,065 | B2 * | 1/2011 | Sugimoto et al. | 358/1.13 |
| 7,878,497 | B2 * | 2/2011 | Adachi | 270/58.23 |
| 2001/0018626 | A1 * | 8/2001 | Moriyama et al. | 700/223 |
| 2001/0021036 | A1 * | 9/2001 | Nimura et al. | 358/1.12 |
| 2009/0206540 | A1 * | 8/2009 | Adachi | 271/9.13 |
| 2013/0175755 | A1 * | 7/2013 | Machida et al. | 271/3.16 |

FOREIGN PATENT DOCUMENTS

JP 3652434 B2 5/2005

* cited by examiner

*Primary Examiner* — Patrick Cicchino
(74) *Attorney, Agent, or Firm* — Sughrue Mion, PLLC

(57) ABSTRACT

An image forming system includes the following elements. An image forming apparatus forms images on plural sheets sequentially transported with a spacing therebetween. A sheet transport apparatus includes a transport section which receives and transports the plural sheets farther downstream. The sheet transport apparatus supplies a different type of sheet from a different-type-of-sheet supply device, inserts it into the spacing, and transports the sheets. The sheet transport apparatus includes the following elements. A transport information obtaining unit obtains information concerning transporting of sheets. A different-type-of-sheet stop unit supplies the different type of sheet, on the basis of the information concerning transporting of sheets, and stops the different type of sheet at a position before the transport section. A different-type-of-sheet supply information output unit outputs information concerning the supply of the different type of sheet, the information being obtained regarding a standby state of the different type of sheet.

2 Claims, 12 Drawing Sheets

IMAGE FORMING SYSTEM AND SHEET TRANSPORT APPARATUS AND METHOD

CROSS-REFERENCE TO RELATED APPLICATIONS

This application is based on and claims priority under 35 USC 119 from Japanese Patent Application No. 2012-156005 filed Jul. 11, 2012.

BACKGROUND

Technical Field

The present invention relates to an image forming system and a sheet transport apparatus and method.

SUMMARY

According to an aspect of the invention, there is provided an image forming system including: an image forming apparatus that forms images on plural sheets which are sequentially transported with a spacing between the plural sheets and that outputs the plural sheets; and a sheet transport apparatus that includes a transport section which receives the plural sheets sequentially transported and output from the image forming apparatus and which transports the plural sheets farther downstream in a transport direction and that supplies a different type of sheet from a different-type-of-sheet supply device, inserts the different type of sheet into a spacing provided between the plural sheets which are transported in the transport section, and transports the different type of sheet and the plural sheets. The sheet transport apparatus includes a transport information obtaining unit that obtains information concerning transporting of sheets from the image forming apparatus, a different-type-of-sheet stop unit that supplies the different type of sheet from the different-type-of-sheet supply device in advance, on the basis of the information concerning transporting of sheets obtained by the transport information obtaining unit, and that stops the different type of sheet at a position before the transport section in a standby state, and a different-type-of-sheet supply information output unit that outputs information concerning the supply of the different type of sheet to the image forming apparatus, the information being obtained regarding the standby state of the different type of sheet.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below in detail with reference to the accompanying drawings.

First Exemplary Embodiment

Figure 1:
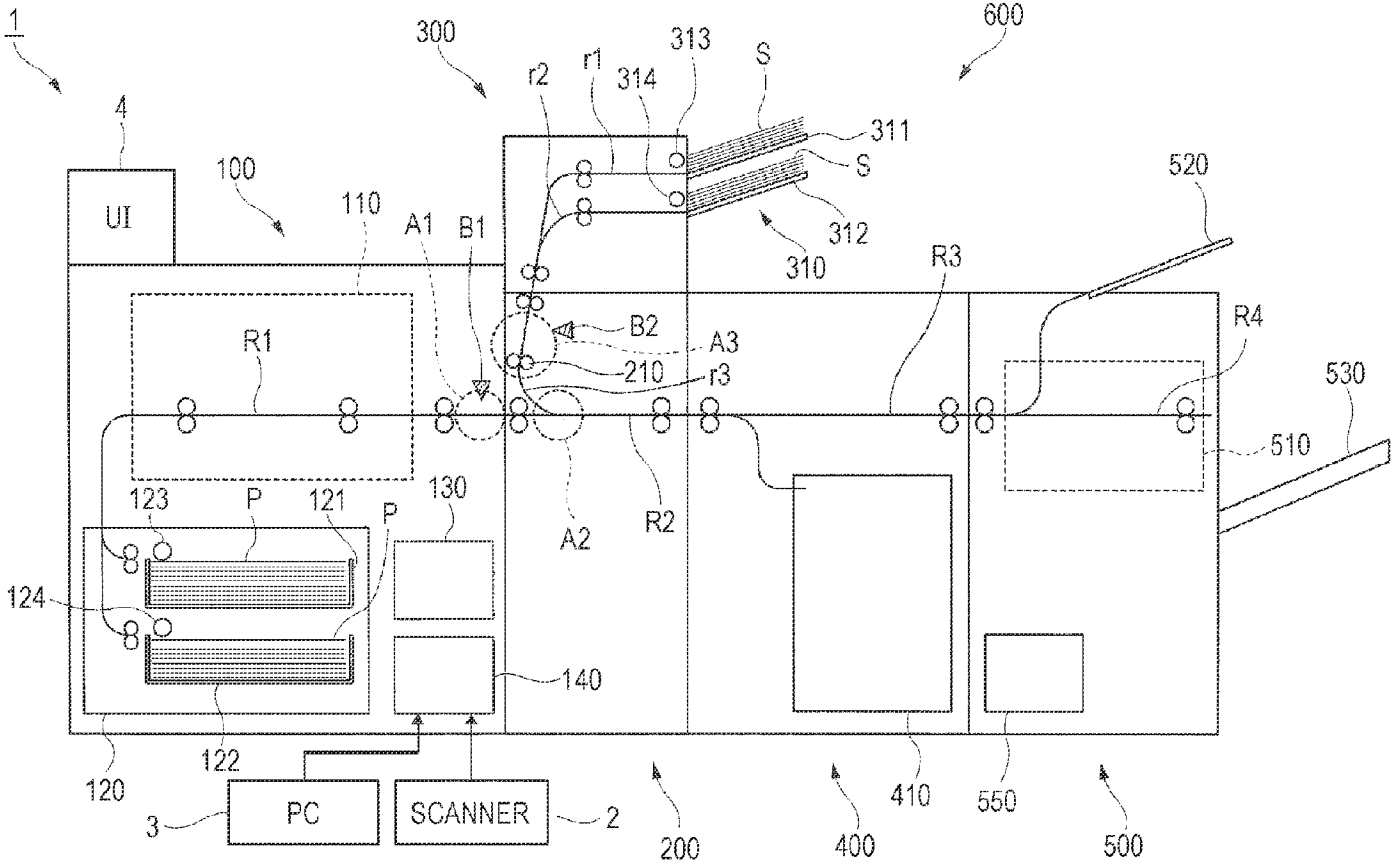
FIG. 1 illustrates the overall configuration of an image forming system according to a first exemplary embodiment of the present invention.

FIG. 1 illustrates the overall configuration of an image forming system 1 according to a first exemplary embodiment of the present invention. The image forming system 1 shown in FIG. 1 includes an image forming apparatus 100, a sheet post-processing apparatus 600, and a user interface (UI) apparatus 4. The image forming apparatus 100 forms an image on a recording material (sheet P). The sheet post-processing apparatus 600 sequentially transports sheets P on which images are formed by the image forming apparatus 100 and performs predetermined post-processing on the sheets P. The UI apparatus 4, which is constituted by a display panel, receives information from a user and displays information for a user.

The configuration of the image forming apparatus 100 will first be discussed below.

The image forming apparatus 100 includes an image forming unit 110, which is an example of an image forming unit, and a sheet supply unit 120, which is an example of a sheet supply unit. The image forming unit 110 forms an image on a sheet P. The sheet supply unit 120 supplies sheets P to the image forming unit 110.

The sheet supply unit 120 includes two sheet storing sections 121 and 122 and feeder rollers 123 and 124. The sheet storing sections 121 and 122 store sheets P therein. The feeder rollers 123 and 124 separate the sheets P one by one output from the sheet storing sections 121 and 122, respectively, and feed the separated sheets P to a first sheet transport path R1. Details of the first sheet transport path R1 will be discussed later.

The image forming apparatus 100 also includes a main controller 130, which is an example of a different-type-of-sheet supply information obtaining unit. The main controller 130 controls the individual elements of the image forming apparatus 100. The main controller 130 includes a central processing unit (CPU) which performs various arithmetic operations, a read only memory (ROM) in which programs executed by the CPU and various items of data are stored, and a random access memory (RAM) used by the CPU as a work memory.

The image forming apparatus 100 also includes an image processor 140 which is connected to a scanner 2 or a personal computer (PC) 3 and which performs image processing on image data received from the scanner 2 or the PC 3. Image data subjected to image processing by the image processor 140 is output to the image forming unit 110.

The image forming apparatus 100 also includes a first sheet transport path R1 through which sheets P supplied from the sheet supply unit 120 are transported toward the sheet post-processing apparatus 600. The above-described image forming unit 110 forms an image on a sheet P which is being transported through the first sheet transport path R1.

In the image forming apparatus 100, a passing position A1 is provided on the downstream side of the first sheet transport path R1 in the transport direction. A sheet P is transported from the first sheet transport path R1 to a second sheet transport path R2 of a transport unit 200 via the passing position A1. The second sheet transport path R2 will be discussed later. The image forming apparatus 100 also includes a sheet detecting sensor B1 disposed on the downstream side of the first sheet transport path R1 in the transport direction. The sheet detecting sensor B1 detects a sheet P transported through the first sheet transport path R1 at the passing position A1.

The image forming apparatus 100 also includes plural transport rollers disposed along the first sheet transport path R1. The plural transport rollers transport sheets P on the first sheet transport path R1. These transport rollers are driven by a transport roller drive motor 150 (see FIG. 2). By turning ON or OFF the transport roller drive motor 150, the operation of the transport rollers can be controlled so that a sheet P will be transported or stopped on the first sheet transport path R1.

In the first exemplary embodiment of the present invention, the image forming unit 110 of the image forming apparatus 100 is capable of forming an image on a sheet P on the basis of, for example, an electrophotographic system. In the electrophotographic system, toner images are formed on image carriers, such as a photoconductor drum and an intermediate transfer body, through a process of charging, exposing, and developing. Then, toner images are transferred onto a sheet P by a transfer device and are fixed on the sheet P by a fixing device.

The sheet post-processing apparatus 600 includes plural units. More specifically, the sheet post-processing apparatus 600 includes a transport unit 200 which transports sheets P transported from the image forming apparatus 100 to the farther downstream side. The sheet post-processing apparatus 600 also includes an interposer 300 which supplies a slip sheet (different type of sheet), such as a front cover sheet, a back cover sheet, or an insertion sheet, to be inserted between sheets P transported from the first sheet transport path R1 for forming a booklet.

The sheet post-processing apparatus 600 also includes a stacker unit 400 and a finisher unit 500. The stacker unit 400 stores therein sheets P transported from the image forming apparatus 100 via the transport unit 200. The finisher unit 500 performs final processing, such as punching or binding, on sheets P passing through the stacker unit 400.

In the first exemplary embodiment of the present invention, the transport unit 200 and the interposer 300 form a sheet transport apparatus.

The sheet post-processing apparatus 600 also includes a sheet processing controller 550 which controls the individual units and the individual elements of the sheet post-processing apparatus 600. In the first exemplary embodiment of the present invention, the sheet processing controller 550 forms a transport information obtaining unit and a different-type-of-sheet supply information output unit.

In the sheet post-processing apparatus 600, the sheet processing controller 550 is provided in the finisher unit 500, however, it may be disposed in a unit other than the finisher unit 500.

The configuration of the transport unit 200 will now be described below.

In the transport unit 200, a second sheet transport path R2 is connected to the downstream side of the first sheet transport path R1 of the image forming apparatus 100 in the transport direction. The second sheet transport path R2 is an example of a transport section through which sheets P transported from the first sheet transport path R1 are transported toward the stacker unit 400. The transport unit 200 also includes a third slip sheet transport path r3. The third slip sheet transport path r3 is connected to the downstream sides of a first slip sheet transport path r1 and a second slip sheet transport path r2, which will be discussed later, of the interposer 300 in the transport direction. A slip sheet S transported from the interposer 300 is transported toward the second sheet transport path R2 through the third slip sheet transport path r3.

A joining position A2 is provided in the transport unit 200. At the joining position A2, a slip sheet S which has been transported through the third slip sheet transport path r3 joins the second sheet transport path R2. A standby position A3 is provided in the third slip sheet transport path r3 of the transport unit 200. At the standby position A3, a slip sheet S waits before being transported to the joining position A2.

A slip sheet detecting sensor B2 is provided at the standby position A3 and detects a slip sheet S which is waiting at the standby position A3. Slip sheet transport rollers 210 are also provided at the standby position A3. The slip sheet transport rollers 210 stop a slip sheet S at the standby position A3 and also transport a slip sheet S waiting at the standby position A3 to the joining position A2. In the first exemplary embodiment of the present invention, the slip sheet transport rollers 210 form a different-type-of-sheet stop unit and a different-type-of-sheet transport unit.

The transport unit 200 also includes plural transport rollers disposed along the second sheet transport path R2 and the third slip sheet transport path r3. The transport rollers transport sheets P and slip sheets S through the second sheet transport path R2 and the third slip sheet transport path r3.

The configuration of the interposer 300 will now be discussed below.

The first and second slip sheet transport paths r1 and r2 are provided in the interposer 300. The first and second slip sheet transport paths r1 and r2 are each connected to the upstream side of the third slip sheet transport path r3 in the transport direction, and transport slip sheets S to the third slip sheet transport path r3.

The interposer 300 also includes plural transport rollers disposed along the first and second slip sheet transport paths r1 and r2. The transport rollers transport slip sheets S through the first and second slip sheet transport paths r1 and r2.

The interposer 300 also includes a slip sheet supply unit 310, which is an example of a different-type-of-sheet supply unit. The slip sheet supply unit 310 supplies slip sheets S, such as front cover sheets, back cover sheets, and sheets to be inserted, to the first and second slip sheet transport paths r1 and r2.

The slip sheet supply unit 310 of the first exemplary embodiment includes a first slip sheet stacking section 311 and a second slip sheet stacking section 312 on which slip sheets S are stacked. The slip sheet supply unit 310 also includes a first slip sheet supply roller 313 and a second slip sheet supply roller 314. The first and second slip sheet supply rollers 313 and 314 separate slip sheets S stacked on the first and second slip sheet stacking sections 311 and 312, respectively, one by one and supply the separated slip sheets S to the first and second slip sheet transport paths r1 and r2, respectively.

The configuration of the stacker unit 400 will now be described below.

The stacker unit 400 includes a third sheet transport path R3 connected to the downstream side of the second sheet transport path R2 of the transport unit 200 in the transport direction. Sheets P and slip sheets S transported through the second sheet transport path R2 are supplied to the finisher unit 500 through the third sheet transport path R3.

The stacker unit 400 also includes plural transport rollers disposed along the third sheet transport path R3. The transport rollers supply sheets P and slip sheets S on the third sheet transport path R3.

The stacker unit 400 also includes a storing section 410 which branches off from the third sheet transport path R3. Sheets P and slip sheets S transported through the third sheet transport path R3 are discharged to and stored in the storing section 410.

The configuration of the finisher unit 500 will now be described below.

The finisher unit 500 includes a fourth sheet transport path R4. The fourth sheet transport path R4 is connected to the downstream side of the third sheet transport path R3 of the stacker unit 400 in the transport direction. Sheets P and slip sheets S transported through the third sheet transport path R3 are transported through the fourth sheet transport path R4.

The finisher unit 500 includes plural transport rollers disposed along the fourth sheet transport path R4. The transport rollers supply sheets P and slip sheets S on the fourth sheet transport path R4.

The finisher unit 500 includes a post-processor 510 which performs post-processing on sheets P transported from the stacker unit 400 through the fourth sheet transport path R4. The post-processor 510 includes a saddle-stitch bookbinding function and a punching function, etc., though they are not shown. The saddle-stitch bookbinding function implements bookbinding by performing saddle-stitch binding on a sheet bundle constituted by sheets P and slip sheets S. The punching function performs, for example, two-hole punching and four-hole punching, on sheets P.

The finisher unit 500 also includes a first sheet discharge section 520 on which sheets P and slip sheets S discharged through a path branching off from the fourth sheet transport path R4 are stacked. The finisher unit 500 also includes a second sheet discharge section 530 disposed on the downstream side of the fourth sheet transport path R4 in the transport direction. Sheets P and slip sheets S transported and discharged through the fourth sheet transport path R4 are stacked on the second sheet discharge section 530.

As stated above, in the first exemplary embodiment of the present invention, the sheet processing controller 550 which controls the individual units and the individual elements of the sheet post-processing apparatus 600 is disposed in the finisher unit 500.

A description will now be given of an example of processing executed in the image forming system 1.

In the image forming system 1 of the first exemplary embodiment of the present invention, the transporting of sheets P from the sheet supply unit 120 of the image forming apparatus 100 to the first sheet transport path R1 is started.

Meanwhile, in the image forming apparatus 100, images are formed on sheets P sequentially transported to the first sheet transport path R1. More specifically, toner images are first formed on image carriers, such as a photoconductor drum or an intermediate transfer body, through a process of charging, exposing, and developing. Then, the toner images are transferred onto a sheet P by a transfer device, and are then fixed on the sheet P by a fixing device.

Then, sheets P on which images are formed are sequentially transported through the second sheet transport path R2 of the transport unit 200, the third sheet transport path R3 of the stacker unit 400, and the fourth sheet transport path R4 of the finisher unit 500, and are then discharged to, for example, the second sheet discharge section 530. With this operation, plural sheets P on which images are formed are stacked in the second sheet discharge section 530 of the finisher unit 500.

If an instruction to insert a slip sheet S between sheets P has been given by using the UI apparatus 4, a slip sheet S is fed to the second sheet transport path R2 by the slip sheet supply unit 310 of the interposer 300.

When inserting a slip sheet S, the sheet supply unit 120 sequentially supplies plural sheets P to the first sheet transport path R1 by leaving a gap (insertion gap) corresponding to the size of the slip sheet S between two sheets P. Details of this operation will be discussed later.

In the interposer 300, before the insertion gap reaches the joining position A2, the interposer 300 supplies a slip sheet S from the slip sheet supply unit 310 and stops the slip sheet S at the standby position A3.

Then, at a predetermining timing, the transporting of the slip sheet S by using the slip sheet transport rollers 210 is started, and then, the slip sheet S is transported from the standby position A3 to the joining position A2 of the second sheet transport path R2, thereby inserting the slip sheet S into the insertion gap between the sheets P. Then, plural sheets P having the slip sheet S transported from the interposer 300 therebetween are output from the transport unit 200 to the stacker unit 400.

Figure 2:
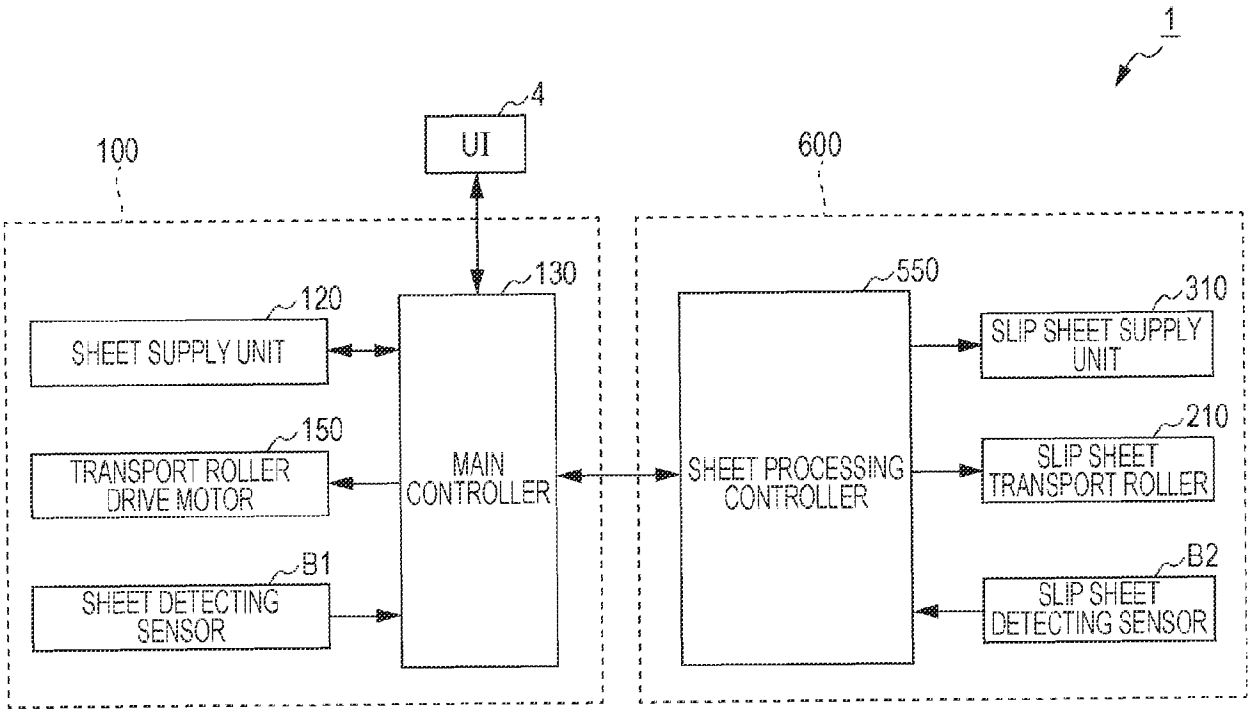
FIG. 2 illustrates a control block of an image forming system according to the first exemplary embodiment.

FIG. 2 illustrates a control block of the image forming system 1 according to the first exemplary embodiment.

In the image forming system 1, as shown in FIG. 2, information concerning, for example, the transporting of sheets P, is output from the main controller 130 provided in the image forming apparatus 100 to the sheet processing controller 550 provided in the sheet post-processing apparatus 600. The sheet processing controller 550 controls the individual mechanisms of the sheet post-processing apparatus 600 on the basis of this information.

Various items of information are input into the image forming apparatus 100. For example, information concerning the insertion of a slip sheet S received via the UI apparatus 4 is input into the main controller 130. Additionally, information concerning the supply of sheets P from the sheet supply unit 120 is input into the main controller 130. Information concerning the transporting of sheets P detected by the sheet detecting sensor B1 is also input into the main controller 130.

The main controller 130 then outputs information concerning the supply of sheets P input from the sheet supply unit 120 and information concerning the transporting of sheets P detected by the sheet detecting sensor B1 to the sheet processing controller 550 of the sheet post-processing apparatus 600.

Information concerning the supply of sheets P to be output from the main controller 130 to the sheet processing controller 550 may be information indicating that a sheet P has been supplied from the sheet supply unit 120. Information concerning the transporting of sheets P may be information indicating that a sheet P has reached the passing position A1.

In the sheet post-processing apparatus 600, information concerning the supply of sheets P and information concerning the transporting of sheets P are input into the sheet processing controller 550 from the main controller 130 of the image forming apparatus 100.

In the sheet post-processing apparatus 600, on the basis of information concerning the supply of sheets P and information concerning the transporting of sheets P input into the sheet processing controller 550, the operations of the slip sheet supply unit 310 provided in the interposer 300 and the slip sheet transport rollers 210 provided in the transport unit 200 are controlled.

Additionally, in the sheet post-processing apparatus 600, information concerning the standby situation of a slip sheet S detected by the slip sheet detecting sensor B2 of the transport unit 200 is input into the sheet processing controller 550. The sheet processing controller 550 then outputs information concerning the standby situation of a slip sheet S detected by the slip sheet detecting sensor B2 to the main controller 130 of the image forming apparatus 100.

Information concerning the standby situation of a slip sheet S output to the main controller 130 from the sheet processing controller 550 may be information indicating that a slip sheet S has reached the standby position A3 or information indicating that an abnormality has occurred before a slip sheet S reaches the standby position A3.

In the image forming apparatus 100, information concerning the standby situation of a slip sheet S is input into the main controller 130 from the sheet processing controller 550 of the sheet post-processing apparatus 600. Then, the main controller 130 of the image forming apparatus 100 controls the driving of the sheet supply unit 120 and the transport roller drive motor 150 on the basis of information concerning the standby situation of a slip sheet S input into the main controller 130. The main controller 130 of the image forming apparatus 100 also controls the display of the UI apparatus 4 on the basis of information concerning the standby situation of a slip sheet S.

A description will now be given of a procedure of slip-sheet insertion processing performed in the image forming system 1 shown in FIG. 1. In the following description, when inserting a slip sheet S between plural sheets P to be transported, a sheet P transported immediately before a slip sheet S may be referred to as a "preceding sheet", and a sheet P transported immediately after a slip sheet S may be referred to as a "succeeding sheet".

Figure 3:
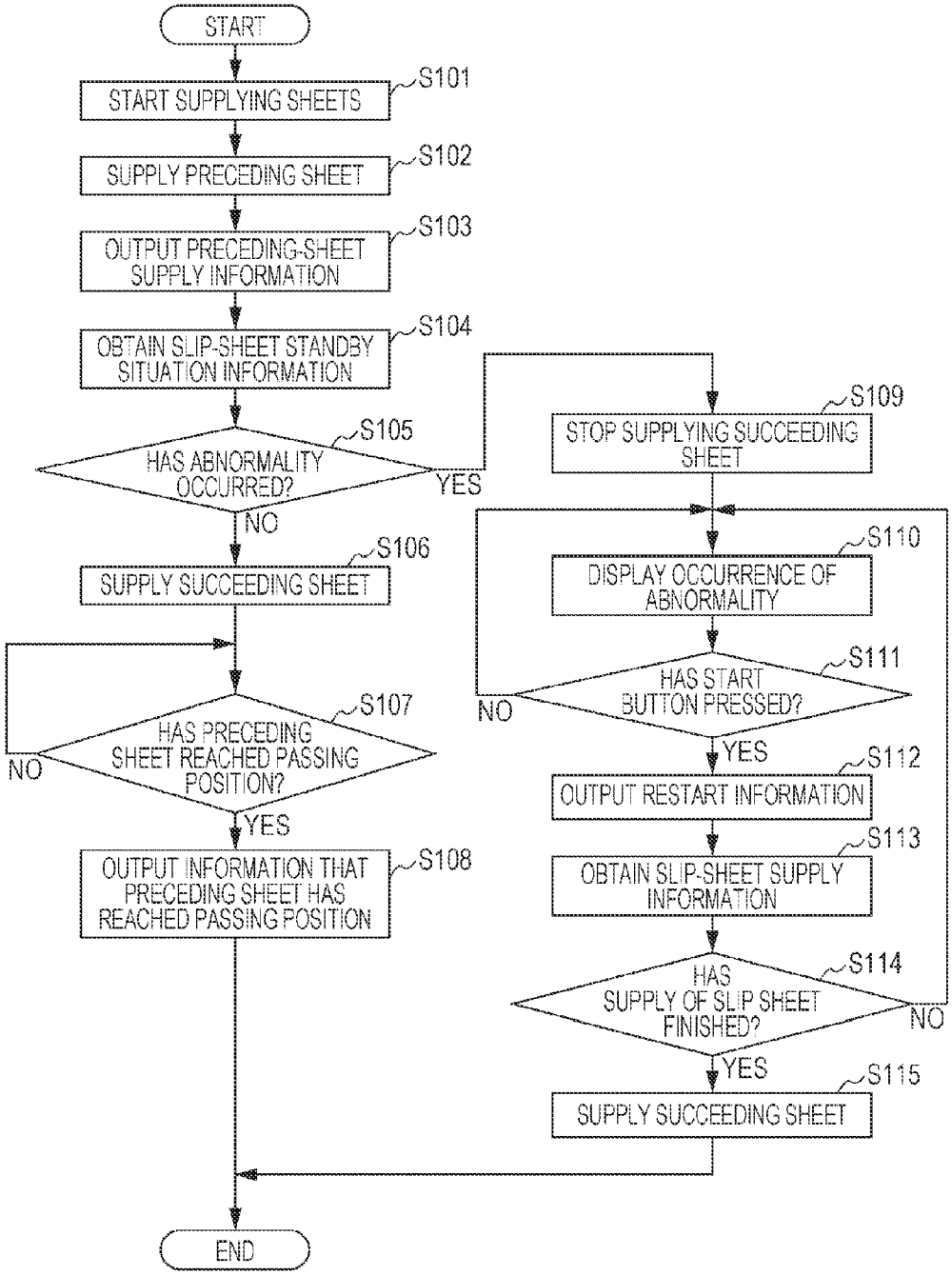
FIG. 3 is a flowchart illustrating a control operation performed by a main controller of the first exemplary embodiment.

A description will first be given of a control operation for slip-sheet insertion processing performed by the main controller 130 of the image forming apparatus 100. FIG. 3 is a flowchart illustrating a control operation performed by the main controller 130 of the first exemplary embodiment.

In step S101, an instruction to form an image is given via the UI apparatus 4 and a start button (not shown) is pressed. Then, the main controller 130 causes the sheet supply unit 120 to start supplying sheets P. The sheet supply unit 120 sequentially supplies plural sheets P one by one to the first sheet transport path R1 under the control of the main controller 130.

Then, in step S102, the main controller 130 causes the sheet supply unit 120 to supply a preceding sheet among the plural sheets P. In step S103, the main controller 130 outputs information indicating that a preceding sheet has been supplied to the sheet processing controller 550 of the sheet post-processing apparatus 600. After the sheet supply unit 120 has supplied the preceding sheet, the main controller 130 stops supplying sheets P including a succeeding sheet, which will be supplied after a slip sheet S, until step S107.

In step S104, the main controller 130 obtains information concerning the standby situation of a slip sheet S from the sheet processing controller 550.

The main controller 130 then determines in step S105 whether the information obtained from the sheet processing controller 550 indicates that an abnormality has occurred before a slip sheet S reaches the standby position A3.

If the main controller 130 determines in step S105 that the information does not indicate the occurrence of an abnormality (if the result of step S105 is NO), i.e., if the main controller 130 determines in step S105 that information concerning the standby situation of a slip sheet S indicates that a slip sheet S has reached the standby position A3, the process proceeds to step S106. In step S106, the main controller 130 causes the sheet supply unit 120 to supply a succeeding sheet to the first sheet transport path R1.

In this case, the controller 130 causes the sheet supply unit 120 to supply a succeeding sheet by leaving a gap (insertion gap) corresponding to the size of a slip sheet S between the succeeding sheet and the preceding sheet, which is being transported through the first transport path R1. That is, the main controller 130 starts supplying a succeeding sheet after the lapse of a predetermined time after supplying the preceding sheet to the first sheet transport path R1. With this arrangement, an insertion gap having a predetermined length is provided between the preceding sheet and the succeeding sheet.

Then, in step S107, it is determined on the basis of an output from the sheet detecting sensor B1 whether the preceding sheet has reached the passing position A1 of the first sheet transport path R1. In this case, if there is a predetermined output from the sheet detecting sensor B1, the main controller 130 determines in step S107 that the preceding sheet has reached the passing position A1.

If it is determined in step S107 that the preceding sheet has reached the passing position A1 (if the result of step S107 is YES), the process proceeds to step S108. In step S108, the main controller 130 outputs information indicating that the preceding sheet has reached the passing position A1 to the sheet processing controller 550.

If it is determined in step S107 that the preceding sheet has not reached the passing position A1 (if the result of step S107 is NO), step S107 is repeated until the preceding sheet reaches the passing position A1.

On the other hand, if it is determined in step S105 that the information obtained from the sheet processing controller 550 indicates that an abnormality has occurred before a slip sheet S reaches the standby position A3 (if the result of step S105 is YES), the process proceeds to step S109. In step S109, the main controller 130 continues transporting sheets P which have been already supplied to the first sheet transport path R1, and also causes the sheet supply unit 120 to stop supplying sheets P including a succeeding sheet.

In step S110, the main controller 130 causes the UI apparatus 4 to display information indicating the occurrence of an abnormality concerning the insertion of a slip sheet S.

Then, in step S111, the main controller 130 determines whether a start button (not shown) has been repressed.

If it is determined in step S111 that the start button has been repressed (if the result of step S111 is YES), the process proceeds to step S112. In step S112, the main controller 130 outputs information indicating that the start button has been pressed to the sheet processing controller 550.

If it is determined in step S111 that the start button has not been repressed (if the result of step S111 is NO), the process returns to step S110, and steps S110 and S111 are repeated.

Subsequently, in step S113, the main controller 130 obtains information concerning the supply of a slip sheet S from the sheet processing controller 550.

Then, in step S114, the main controller 130 determines whether the information concerning the supply of a slip sheet S obtained from the sheet processing controller 550 in step S113 is a signal indicating the completion of the supply of a slip sheet S.

If it is determined in step S114 that the information is a signal indicating the completion of the supply of a slip sheet S (if the result of step S114 is YES), the process proceeds to step S115. In step S115, the main controller 130 causes the sheet supply unit 120 to supply a succeeding sheet to the first sheet transport path R1. The main controller 130 then supplies and transports sheets P in response to an instruction received from a user via the UI apparatus 4. Then, the slip-sheet insertion processing has been completed.

If it is determined in step S114 that the information obtained from the sheet processing controller 550 is not a signal indicating the completion of the supply of a slip sheet S (if the result of step S114 is NO), the main controller 130 returns to step S110, and causes the UI apparatus 4 to display information indicating the occurrence of an abnormality concerning the insertion of a slip sheet S.

Figure 4:
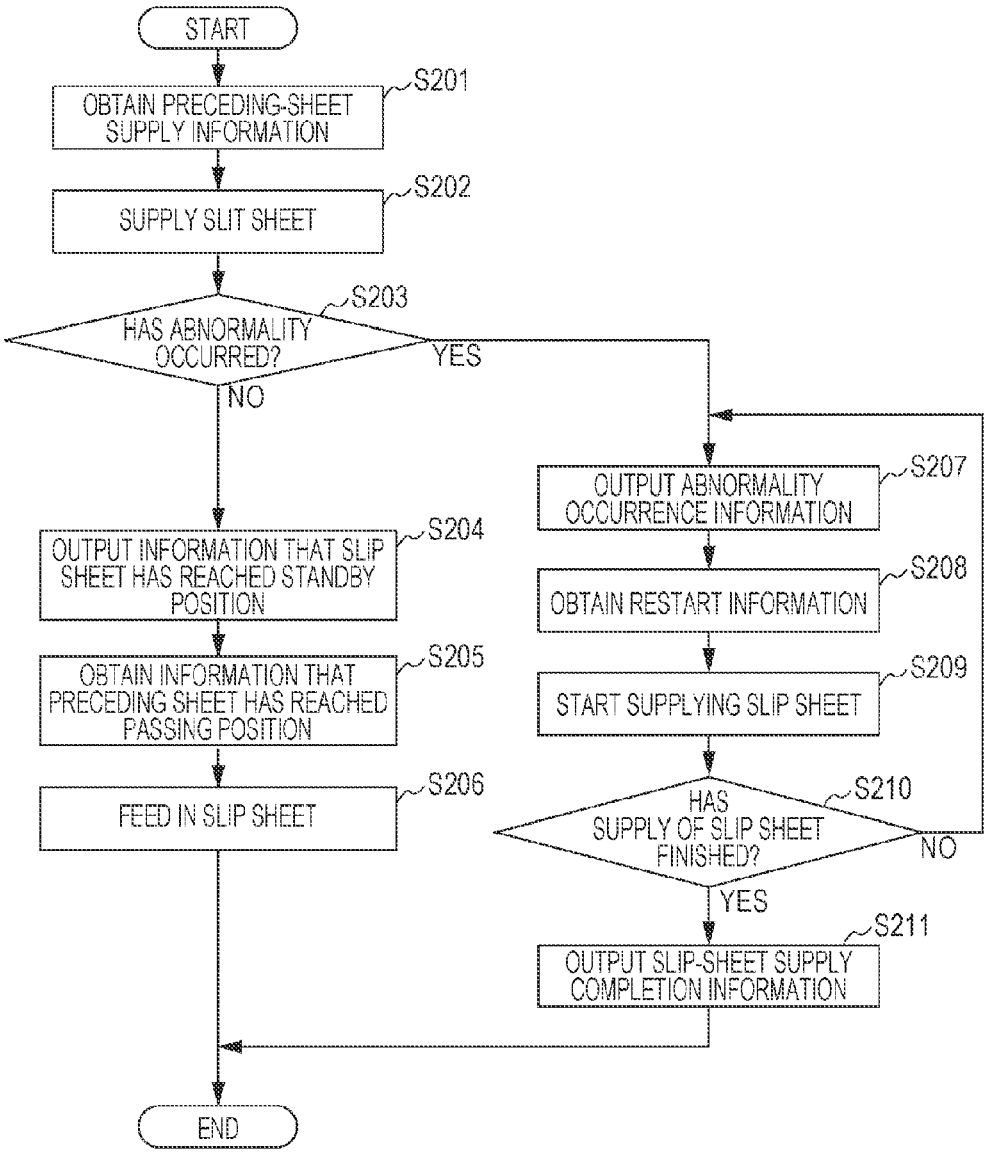
FIG. 4 is a flowchart illustrating a control operation performed by a sheet processing controller of the first exemplary embodiment.

A description will now be given of a control operation for slip-sheet insertion processing performed by the sheet processing controller 550 of the sheet post-processing apparatus 600. FIG. 4 is a flowchart illustrating a control operation performed by the sheet processing controller 550 of the first exemplary embodiment.

Upon starting an image forming operation after a start button is pressed in the image forming apparatus 100, in step S201, the sheet processing controller 550 obtains information indicating that a preceding sheet has been supplied output from the main controller 130 in step S103.

In step S202, the sheet processing controller 550 causes the slip sheet supply unit 310 to supply a slip sheet S to the standby position A3.

The sheet processing controller 550 then determines in step S203 on the basis of an output from the slip sheet detecting sensor B2 whether an abnormality has occurred before a slip sheet S reaches the standby position A3. More specifically, if there is a predetermined output from the slip sheet detecting sensor B2 at a predetermined timing, the sheet processing controller 550 determines that an abnormality has not occurred before a slip sheet S reaches the standby position A3 (if the result of step S203 is NO). If there is no predetermined output from the slip sheet detecting sensor B2 at a predetermined timing, the sheet processing controller 550 determines that an abnormality has occurred before a slip sheet S reaches the standby position A3 (if the result of step S203 is YES). The occurrence of an abnormality before a slip sheet S reaches the standby position A3 is a situation in which a slip sheet S is unable to be supplied to the standby position A3 due to, for example, a jam of a slit sheet S in the first or second slip sheet transport path r1 or r2 or a paper-out condition in which there is no slip sheet S stacked on the sheet supply unit 310.

If it is determined in step S203 that an abnormality has not occurred before a slip sheet S reaches the standby position A3 (if the result of step S203 is NO), the process proceeds to step S204. In step S204, the sheet processing controller 550 outputs information indicating that a slip sheet S has reached the standby position A3 to the main controller 130.

Then, in step S205, the sheet processing controller 550 obtains information indicating that a preceding sheet has reached the passing position A1 output from the main controller 130 in step S108.

In step S206, the sheet processing controller 550 causes the slip sheet transport rollers 210 to feed in the slip sheet S waiting at the standby position A3 to the joining position A2.

As stated above, the main controller 130 sequentially supplies and transports plural sheets P by leaving an insertion gap to insert a slip sheet S between a preceding sheet and a succeeding sheet. With this arrangement, the slip sheet S fed to the joining position A2 by the sheet processing controller 550 is inserted into the insertion gap between the preceding sheet and the succeeding sheet.

Subsequently, in response to an instruction received by the main controller 130 from a user via the UI apparatus 4, the sheet processing controller 550 transports the slip sheet S and sheets P. Then, the slip-sheet insertion processing has been completed.

On the other hand, if it is determined in step S203 that an abnormality has occurred before a slip sheet S reaches the standby position A3, the process proceeds to step S207. In step S207, the sheet processing controller 550 outputs information indicating that an abnormality has occurred before a slip sheet S reaches the standby position A3 to the main controller 130.

Then, in step S208, the sheet processing controller 550 obtains information indicating that the start button has been repressed output from the main controller 130 in step S112. In step S209, the sheet processing controller 550 causes the slip sheet supply unit 310 to supply a slip sheet S.

In step S209, the sheet processing controller 550 causes the slip sheet S to pass through the standby position A3 without stopping it at the standby position A3 and supplies the slip sheet S to the joining position A2.

Then, in step S210, the sheet processing controller 550 determines on the basis of an output from the slip sheet detecting sensor B2 whether the supply of a slip sheet S from the slip sheet supply unit 310 has finished. If there is a predetermined output from the slip sheet detecting sensor B2 at a predetermined timing, the sheet processing controller 550 determines that the supply of a slip sheet S has finished (the result of step S210 is YES). If there is no predetermined output from the slip sheet detecting sensor B2, the sheet processing controller 550 determines that the supply of a slip sheet S has not finished (the result of step S210 is NO).

If it is determined in step S210 that the supply of a slip sheet S has finished, the process proceeds to step S211. In step S211, the sheet processing controller 550 outputs a signal indicating the completion of the supply of a slip sheet S to the main controller 130.

Then, the sheet processing controller 550 transports the slip sheet S and sheets P in response to an instruction received by the main controller 130 from a user via the UI apparatus 4. Then, the slip sheet insertion processing has been completed.

On the other hand, if it is determined in step S210 that the supply of a slip sheet S has not finished, the process returns to step S207. In step S207, the sheet processing controller 550 continues outputting information indicating that an abnormality has occurred before a slip sheet S reaches the standby position A3 to the main controller 130.

Specific examples of slip-sheet insertion processing performed by the main controller 130 and the sheet processing controller 550 will be described below with reference to FIGS. 5A through 7D.

FIGS. 5A through 7D illustrate slip-sheet insertion processing performed by the main controller 130 and the sheet processing controller 550 according to the first exemplary embodiment. FIGS. 5A through 6C illustrate an example of slip-sheet insertion processing when an abnormality has not occurred before a slip sheet S reaches the standby position A3. FIGS. 7A through 7D illustrate an example of slip-sheet insertion processing when an abnormality has occurred before a slip sheet S reaches the standby position A3. In FIGS. 5A through 7D, the configurations of the image forming apparatus 100, the transport unit 200, and the interposer 300 are simplified for ease of representation.

It is assumed that, in the examples shown in FIGS. 5A through 7D, an instruction to insert a slip sheet S between sheets P4 and P5 among plural sheets P (sheets P1, P2, P3, and so on) supplied from the sheet supply unit 120 and sequentially transported has been given through the UI apparatus 4. That is, in these examples, the sheet P4 is a preceding sheet, and the sheet P5 is a succeeding sheet.

In the image forming system 1, a start button (not shown) is pressed, and the main controller 130 starts supplying sheets P. Then, the sheets P1, P2, P3, and so on are sequentially supplied to the first sheet transport path R1 by the sheet supply unit 120 (step S101). The sheets P supplied to the first sheet transport path R1 are then sequentially transported through the first sheet transport path R1 and the second sheet transport path R2.

In the first exemplary embodiment, the plural sheets P are sequentially transported at regular spacings, except for the sheet P4, which is a preceding sheet, and the sheet P5, which is a succeeding sheet, between which a slip sheet S will be inserted.

Figure 5A:
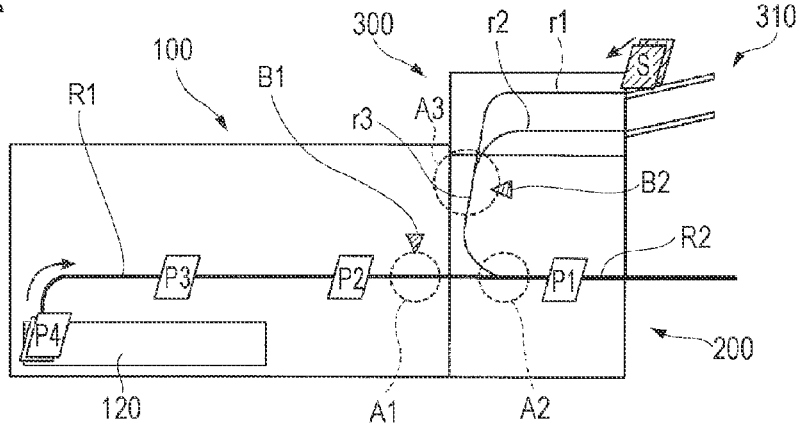
FIGS. 5A through 7D illustrate slip-sheet insertion processing performed by a main controller and a sheet processing controller according to the first exemplary embodiment.

Then, as shown in FIG. 5A, when the main controller 130 causes the sheet supply unit 120 to supply the sheet P4, which is a preceding sheet (step S102), the sheet processing controller 550 causes the slip sheet supply unit 310 to start supplying a slip sheet S (step S202) on the basis of information indicating that a preceding sheet has been supplied obtained from the main controller 130 (step S103, step S201). In the example shown in FIGS. 5A through 5C, the slip sheet supply unit 310 supplies a slip sheet S stacked on the first slip sheet stacking section 311 (see FIG. 1) via the first slip sheet transport path r1. After the sheet P4, which is a preceding sheet, has been supplied, the main controller 130 stops supplying subsequent sheets, i.e., sheets P5, P6, and so on.

Figure 5B:
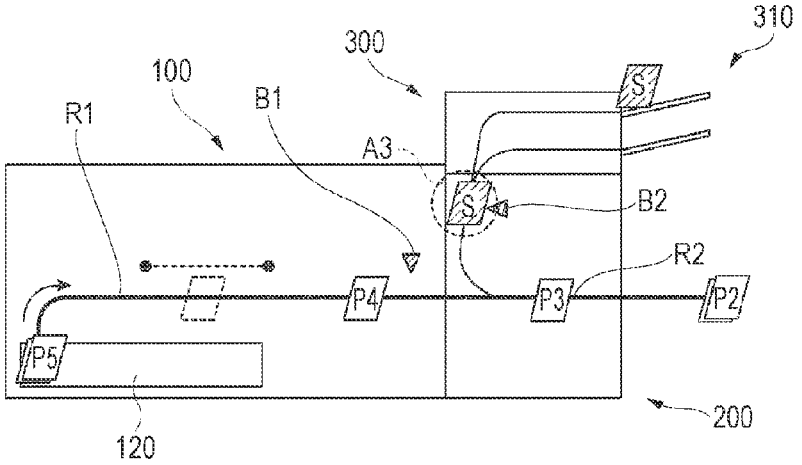

If there is no occurrence of an abnormality, such as a jam, in the first slip sheet transport path r1, a slip sheet S supplied by the slip sheet supply unit 310 reaches the standby position A3, as shown in FIG. 5B. When the slip sheet S has reached the standby position A3, the driving of the slip sheet transport rollers 210 has stopped. Accordingly, the slip sheet S has stopped at the standby position A3 and waits at the standby position A3. Then, the sheet processing controller 550 determines on the basis of an output from the slip sheet detecting sensor B2 whether an abnormality has occurred before the slip sheet S reaches the standby position A3 (step S203). In the example shown in FIGS. 5A through 5C, an abnormality, such as a jam of the slip sheet S, has not occurred, and the slip sheet S has reached the standby position A3. Accordingly, a predetermined output from the slip sheet detecting sensor B2 has been detected. Thus, the sheet processing controller 550 determines that an abnormality has not occurred before the slip sheet S reaches the standby position A3.

Then, the sheet processing controller 550 outputs information indicating that a slip sheet S has reached the standby position A3 to the main controller 130 (step S204). Under the control of the main controller 130, the sheet supply section 120 then supplies the sheet S5, which is a succeeding sheet, to the first sheet transport path R1 (steps S105 and S106). When supplying the sheet P5, as shown in FIG. 5B, a gap (insertion gap) corresponding to the size of the slip sheet S is provided between the sheet P4, which is a preceding sheet, and the sheet P5.

Figure 5C:
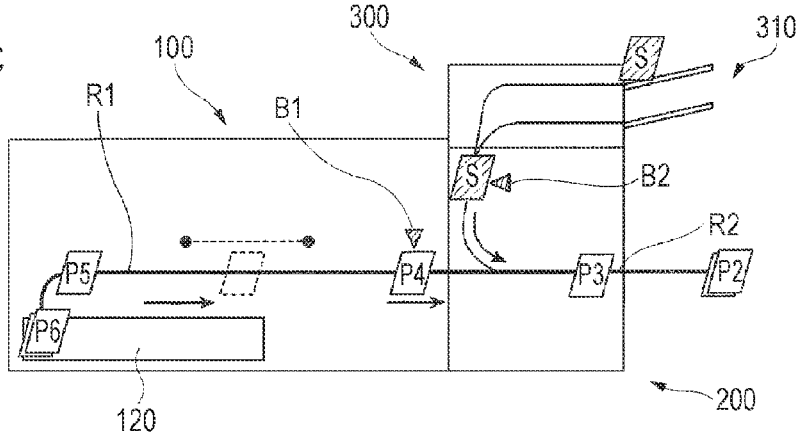

In the first exemplary embodiment, the sheets P are transported through the first and second sheet transport paths R1 and R2 at a constant speed from the upstream side to the downstream side in the transport direction. Accordingly, as shown in FIGS. 5B and 5C, the sheet P4, which is a preceding sheet, and the sheet P5, which is a succeeding sheet, are transported toward the downstream side while maintaining a length of the insertion gap provided between the sheet P4 and the sheet P5.

The length of the insertion gap is set to be, for example, twice as long as a gap between sheets P other than the sheets P4 and P5 transported through the first and second sheet transport paths R1 and R2.

When the sheet P4, which is a preceding sheet, is transported to the passing position A1, information indicating that the sheet P4 has reached the passing position A1 is output from the main controller 130 to the sheet processing controller 550 on the basis of an output from the sheet detecting sensor B1 (steps S107 and S108). Then, upon receiving this information from the main controller 130, the sheet processing controller 550 starts driving the slip sheet transport rollers 210 and other rollers, as shown in FIGS. 5C and 6A, thereby starting feeding the slip sheet S to the joining position A2 from the standby position A3 (steps S205 and S206).

In the image forming apparatus 100, the sheet P4 transported to the passing position A1 is continuously transported through the first and second sheet transport paths R1 and R2. When the slip sheet S has reached the joining position A2 from the standby position A3, the sheet P4, which is a preceding sheet, is being transported farther downstream than the joining position A2 in the transport direction of the second sheet transport path R2, as shown in FIG. 6A. Meanwhile, the sheet P5, which is a succeeding sheet, is being transported through the first sheet transport path R1 while maintaining a length of the insertion gap provided between the sheet P4 and the sheet P5.

Figure 6A:
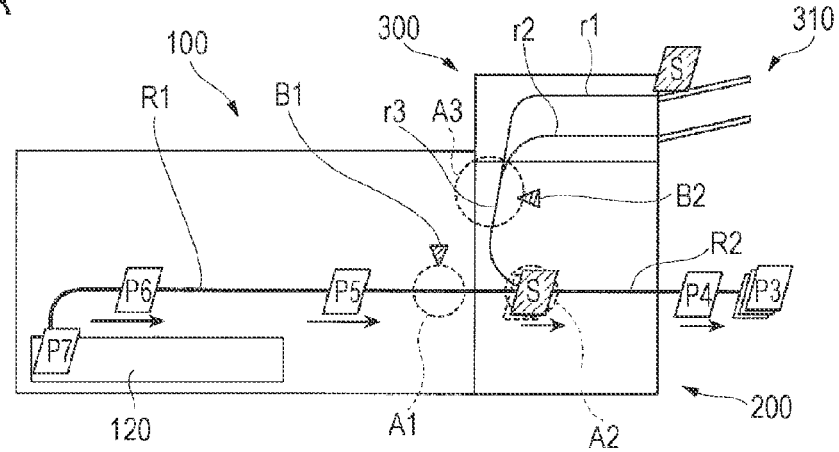

With this operation, as shown in FIG. 6A, the slip sheet S transported from the standby position A3 to the joining position A2 is inserted, at a position corresponding to the insertion gap, between the sheet P4, which is a preceding sheet, and the sheet P5, which is a succeeding sheet.

Figure 6B:
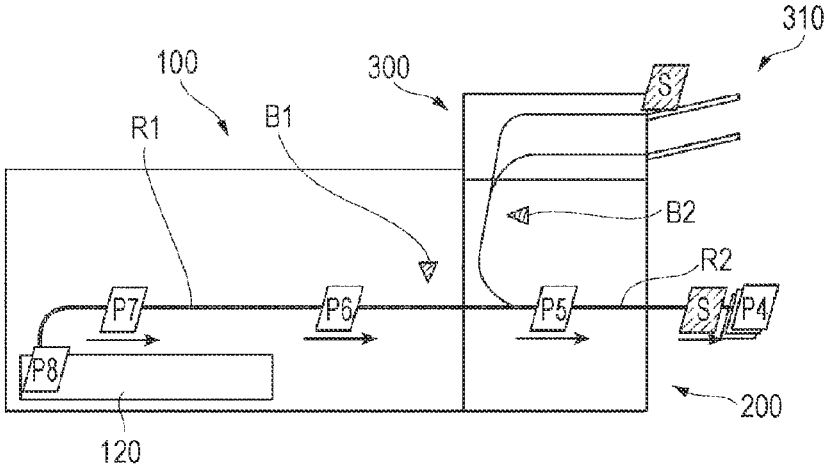
Figure 6C:
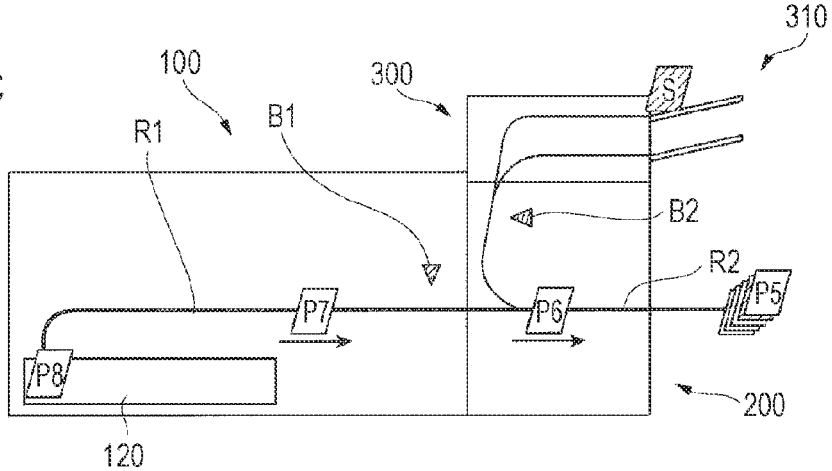

The plural sheets P are sequentially transported through the second sheet transport path R2 in the state in which the slip sheet S is inserted between the sheet P4 and the sheet P5, and are sequentially output from the transport unit 200 in the order specified by a user through the use of the UI apparatus 4 (i.e., the sheets P1, P2, P3, P4, the slip sheet S, the sheets P5, P6, and so on), as shown in FIGS. 6B and 6C.

Figure 7A:
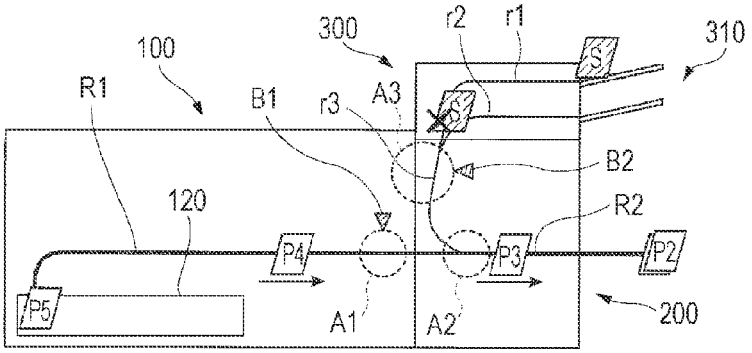

A description will now be given, with reference to FIGS. 7A through 7D, of processing when an abnormality has occurred before a slip sheet S reaches the standby position A3. In this example, as shown in FIG. 7A, it is assumed that a jam of a slip sheet S has occurred in the first slip sheet transport path r1 while supplying the slip sheet S by using the slip sheet supply unit 310 in step S202.

Due to the occurrence of a jam of the slip sheet S in the first slip sheet transport path r1, the slip sheet S is unable to reach the standby position A3. Accordingly, since there is no predetermined output from the slip sheet detecting sensor B2, the sheet processing controller 550 determines that an abnormality has occurred before the slip sheet S reaches the standby position A3 (step S203), and outputs information indicating the occurrence of an abnormality to the main controller (step S207).

Figure 7B:
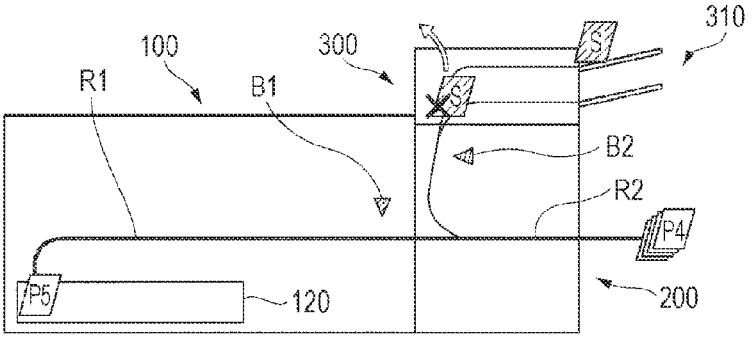

Upon receiving this information from the sheet processing controller 550, the main controller 130 causes the sheet supply unit 120 to stop supplying the sheets P5, P6, and so on (step S109). As shown in FIG. 7A, the main controller 130 and the sheet processing controller 550 continue transporting the sheets P3 and P4 which are being transported through the first or second sheet transport path R1 or R2. Then, as shown in FIG. 7B, the sheets P3 and P4 transported prior to the slip sheet S are sequentially output from the transport unit 200 through the second sheet transport path R2.

Subsequently, the main controller 130 displays information indicating the occurrence of an abnormality concerning the insertion of a slip sheet S by using the UI apparatus 4 (see FIG. 1) (step S110).

Figure 7C:
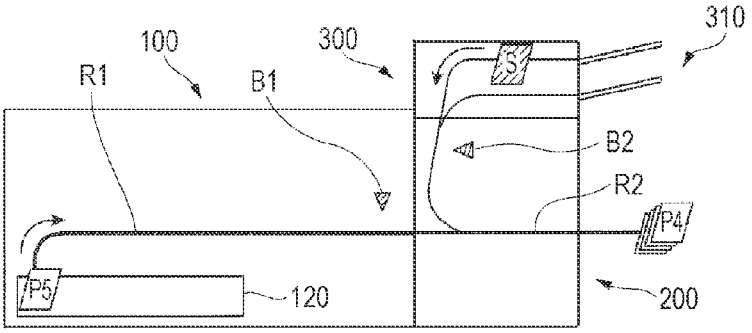

If the jammed slip sheet S is removed from the interposer 300 and the start button is repressed by a user on the basis of information displayed on the UI apparatus 4 (step S111 and S208), the sheet processing controller 550 starts supplying a new slip sheet S by using the slip sheet supply unit 310, as shown in FIG. 7C (step S209).

When the new slip sheet S has reached the standby position A3 and there is a predetermined output from the slip sheet detecting sensor B2, the sheet processing controller 550 outputs information indicating the completion of the supply of the new slip sheet S to the main controller 130 (steps S210 and S211). When supplying the new slip sheet S, the sheet processing controller 550 may directly transport the slip sheet S to the joining position A2 by using the slip sheet supply unit 310 without stopping the slip sheet S at the standby position A3.

Figure 7D:
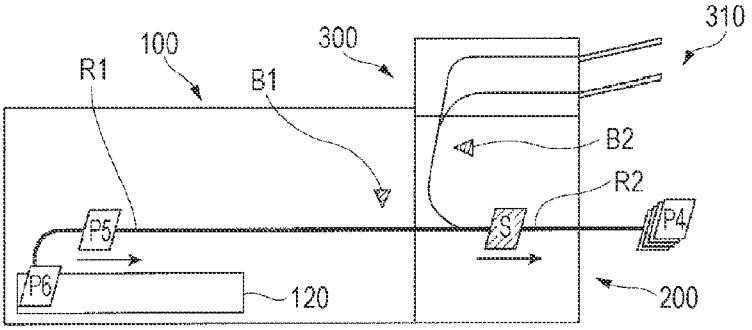

Then, the main controller 130 starts supplying the sheet P5, which is a succeeding sheet, from the sheet supply unit 120, as shown in FIG. 7D, on the basis of information indicating the completion of the supply of a slip sheet S obtained from the sheet processing controller 550 (step S115).

In the first exemplary embodiment, before the sheet P5 is supplied from the sheet supply unit 120, the supply of the slip sheet S to the joining position A2 by using the slip sheet supply unit 310 has already started. Accordingly, as shown in FIG. 7D, the sheet P5 is transported to a position subsequent to the slip sheet S which is being transported through the second sheet transport path R2. Then, the slip sheet S and the sheet P5 are sequentially transported through the second sheet transport path R2 in this order and are sequentially output from the transport unit 200.

As stated above, in the first exemplary embodiment, before the new slip sheet S and the sheet P5 are supplied, the sheet P4, which is a preceding sheet, has already been output from the transport unit 200.

With this operation, by sequentially outputting the slip sheet S and the sheet P5 from the transport unit 200, the plural sheets P and the slip sheet S output from the transport unit 200 are arranged in a predetermined order (sheets P1, P2, P3, P4, the slip sheet S, the sheets P5, P6, and so on) selected by a user through the use of the UI apparatus 4.

Slip-sheet insertion processing performed in the image forming system 1 according to an example of the related art will be described below with reference to FIGS. 12A through 12D. In FIGS. 12A through 12D, the configurations of elements similar to those of the first exemplary embodiment are designated by like reference numerals, and a detailed explanation thereof will be omitted. In this example, it is assumed that a slip sheet S is inserted between a sheet P4 (preceding sheet) and a sheet P5 (succeeding sheet) among plural sheets P to be sequentially transported.

Figure 12A:
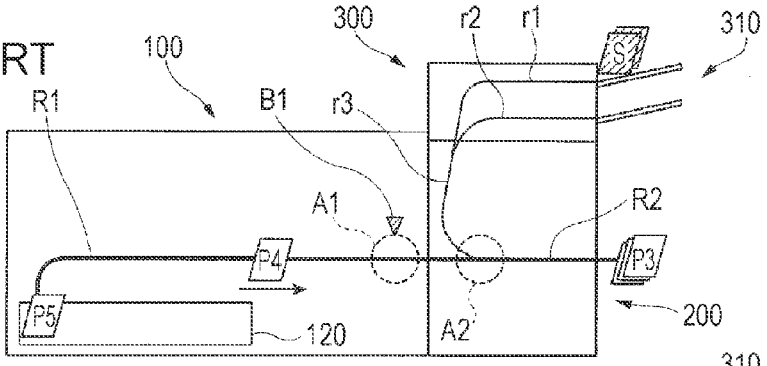
FIG. 12A RELATED ART
FIGS. 12A through 12D illustrate slip-sheet insertion processing performed by an image forming system of an example of the related art.
Figure 12B:
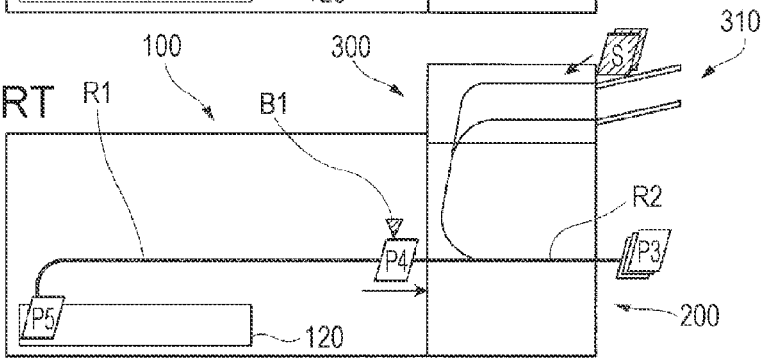
FIG. 12B RELATED ART

In the example of the related art shown in FIGS. 12A through 12D, when a start button is pressed in response to an instruction to form an image through the use of the UI apparatus 4 (see FIG. 1), the main controller 130 causes the sheet supply unit 120 to sequentially supply plural sheets P to the first sheet transport path R1. Then, as shown in FIG. 12A, when the sheet P4, which is a preceding sheet, is supplied by the sheet supply unit 120, the main controller 130 (see FIG. 2) suspends the supply of the sheet P5, which is a succeeding sheet. The main controller 130 continues supplying the sheet P4 through the first sheet transport path R1.

When the sheet P4, which is a preceding sheet, has reached the passing position A1 on the first sheet transport path R1 by using the sheet supply unit 120, the main controller 130 determines that the sheet P4 has reached the passing position A1 on the basis of an output from the sheet detecting sensor B1, and outputs information indicating that the sheet P4 has reached the passing position A1 to the sheet processing controller 550 (see FIG. 2). Upon receiving this information, the sheet processing controller 550 causes the slip sheet supply unit 310 to start supplying a slip sheet S to the joining position A2.

The sheet P4, which has reached the passing position A1, is continuously transported from the first sheet transport path R1 to the second sheet transport path R2 and passes the joining position A2. Accordingly, when the slip sheet S supplied from the slip sheet supply unit 310 reaches the joining position A2, the sheet P4 has already been transported farther downstream than the joining position A2 on the second sheet transport path R2 in the transport direction.

Figure 12C:
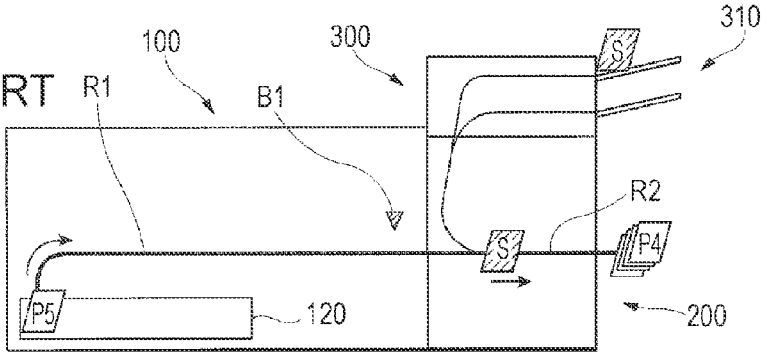
FIG. 12C RELATED ART

Thus, as shown in FIG. 12C, the slip sheet S is inserted subsequent to the sheet P4 in the transport direction on the second sheet transport path R2.

Figure 12D:
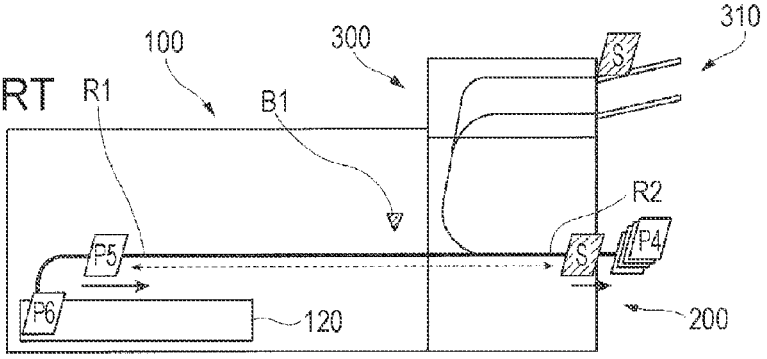
FIG. 12D RELATED ART

Then, as shown in FIG. 12D, after the slip sheet S has been supplied by the slip sheet supply unit 310 and has passed the joining position A2 on the second sheet transport path R2, the main controller 130 causes the sheet supply unit 120 to start supplying the sheet P5 to the first sheet transport path R1. Then, the main controller 130 and the sheet processing controller 550 sequentially transport the sheet P4, the slip sheet S, the sheet P5, and so on, through the first and second sheet transport paths R1 and R2, and sequentially output them from the transport unit 200 through the second sheet transport path R2.

As discussed above, in the example of the related art shown in FIGS. 12A through 12D, after finishing feeding the slip sheet S to the second sheet transport path R2 by using the slip sheet supply unit 310, the supply of a succeeding sheet (sheet P5) is started.

However, as in the above-described example of the related art, if the supply of a succeeding sheet is started after a slip sheet S has been fed to the second sheet transport path R2, the spacing between the slip sheet S positioned on the second transport path R2 and the succeeding sheet (sheet P5) positioned on the first transport path R1 becomes large, as shown in FIG. 12D. This increases the total time taken to transport plural sheets P and a slip sheet S to be inserted between sheets P. As a result, the productivity of processing performed in the image forming system 1 may be decreased.

Additionally, in the example of the related art shown in FIGS. 12A through 12D, when supplying a slip sheet S to the joining position A2 on the second sheet transport path R2, the slip sheet S is directly supplied to the joining position A2 from the slip sheet supply unit 310 without stopping the slip sheet S at the standby position A3 (see FIG. 1). The distance from the slip sheet supply unit 310 to the joining position A2 is longer than that from the standby position A3 to the joining position A2. Accordingly, the time taken to supply the slip sheet S from the slip sheet supply unit 310 to the joining position A2 is longer than that from the standby position A3 to the joining position A2.

Then, as in the above-described example of the related art, if the supply of a slip sheet S from the slip sheet supply unit 310 is started after a preceding sheet passes through the passing position A1, the spacing between the slip sheet S and the preceding sheet becomes larger since it takes time to supply the slip sheet S to the joining position A2. Thus, the total time taken to transport the sheets P and the slip sheet S may be increased. As a result, the productivity of processing performed in the image forming system 1 may be decreased.

In contrast, in the above-described image forming system 1 of the first exemplary embodiment, when performing insertion processing for a slit sheet S from the interposer 300, the slip sheet S is stopped at the standby position A3 of the transport unit 200 in advance, on the basis of information concerning the supply of a sheet P (in the first exemplary embodiment, the sheet P4, which is a preceding sheet) input into the sheet processing controller 550 of the sheet post-processing apparatus 600 from the main controller 130 of the image forming apparatus 100.

Then, in the image forming apparatus 100, on the basis of information concerning the supply of the slip sheet S (information indicating that the slip sheet S has reached the standby position A3) detected by the slip sheet detecting sensor B2 positioned at the standby position A3 and input from the sheet processing controller 550, the main controller 130 starts supplying a succeeding sheet (sheet P5) from the sheet supply unit 120. Additionally, in the first exemplary embodiment, on the basis of information concerning the transporting of the preceding sheet (sheet P4) (information indicating that the sheet P4 has reached the passing position A1) detected by the sheet detecting sensor B1 of the image forming apparatus 100 and input from the main controller 130, the sheet processing controller 550 transports the slip sheet S waiting at the standby position A3 to the joining position A2.

With this configuration, in the image forming system 1 of the first exemplary embodiment, when inserting a slip sheet S between plural sheets P (in the first exemplary embodiment, between the sheet P4 and the sheet P5), the spacing between a preceding sheet (sheet P4) and the slip sheet S and between the slip sheet S and a succeeding sheet (sheet P5) is smaller than that of the example of the related art shown in FIGS. 12A through 12D.

Accordingly, the total time taken to transport plural sheets P and a slip sheet S to be inserted between sheets P does not become long, and thus, the productivity of processing performed in the image forming system 1 is maintained.

Additionally, in the image forming system 1, the distance from the standby position A3 to the joining position A2 is smaller than that between the slip sheet supply section 310 to the joining position A2. Accordingly, as in the first exemplary embodiment, by supplying a slip sheet S from the standby position A3 to the joining position A2, the time taken to supply a slip sheet S subsequent to a preceding sheet (sheet P4) is shorter than the time taken to directly supply a slip sheet S from the slip sheet supply unit 310 to the joining position A2, as in the related art. Thus, the spacing between the preceding sheet and the slip sheet S becomes smaller. With this configuration, it is possible to maintain the productivity in the image forming system 1, compared with a case in which the configuration of the first exemplary embodiment is not employed.

In particular, in the first exemplary embodiment, the standby position A3 is disposed, not in the interposer 300, but in the transport unit 200. With this arrangement, the distance from the standby position A3 to the joining position A2 is smaller than that when the standby position A3 is disposed in the interposer 300. With this configuration, it is possible to maintain the productivity in the image forming system 1, compared with a case in which the configuration of the first exemplary embodiment is not employed.

In the stacker unit 400 connected to the downstream side of the transport unit 200 in the transport direction, plural sheets P and a slip sheet S inserted between sheets P output from the transport unit 200 may be stacked. Additionally, in the finisher unit 500 connected to the downstream side of the stacker unit 400, final processing, such as binding processing, may be performed on sheets P and a slip sheet S stacked in the stacker unit 400.

In the first exemplary embodiment, the spacing between a preceding sheet (sheet P4) and a slip sheet S and the spacing between a slip sheet S and a succeeding sheet (sheet P5) do not become large. Accordingly, when stacking plural sheets P and a slip sheet S in the stacker unit 400 or when performing final processing in the finisher unit 500, it does not take a long time to stack sheets P and a slip sheet S or to perform final processing.

With this configuration, it is possible to maintain the productivity of stacking processing performed in the stacker unit 400 or final processing, such as binding processing, performed in the finisher unit 500, compared with a case in which the configuration of the first exemplary embodiment is not employed.

In the finisher unit 500, punching processing may be performed on plural sheets P and slip sheets S one by one sequentially output from the transport unit 200.

In the first exemplary embodiment, the spacing between a preceding sheet (sheet P4) and a slip sheet S and the spacing between a slip sheet S and a succeeding sheet (sheet P5) do not become large. Accordingly, the spacing between sheets P (and slip sheets S) subjected to final processing is also decreased. Thus, when sequentially performing punching on plural sheets P and slip sheets S, it is possible to decrease the time taken to finish processing on all the sheets P and slip sheets S, compared with a case in which the configuration of the first exemplary embodiment is not employed.

With this configuration, it is possible to maintain the productivity of final processing, such as punching processing, sequentially performed on sheets P and slip sheets S, by the finisher unit 500, compared with a case in which the configuration of the first exemplary embodiment is not employed.

Additionally, in the image forming system 1 of the first exemplary embodiment, before a slip sheet S supplied from the slip sheet supply unit 310 is stopped at the standby position A3, the sheet processing controller 550 checks for the occurrence of an abnormality, such as a jam. Upon the occurrence of an abnormality, such as a jam, information indicating that an abnormality has occurred before a slip sheet S reaches the standby position A3 is output from the sheet processing controller 550 to the main controller 130. Then, on the basis of this information, the main controller 130 controls the transporting of the sheet P4, which is a preceding sheet, or the supply of the sheet P5, which is a succeeding sheet.

With this operation, even when an abnormality, such as a jam, has occurred before a slip sheet S reaches the standby position A3, the slip sheet S can be inserted between a predetermined preceding sheet (sheet P4) and a predetermined succeeding sheet (sheet P5). As a result, plural sheets P and slip sheets S are not output from the transport unit 200 in an order different from a predetermined order.

Moreover, as stated above, in the image forming system 1 of the first exemplary embodiment, the standby position A3 at which a slip sheet S is stopped is disposed in the third slip sheet transport path r3 of the transport unit 200, and the slip sheet detecting sensor B2 is provided at the standby position A3. Then, the sheet processing controller 550 determines, on the basis of the presence or the absence of an output from the slip sheet detecting sensor B2, whether an abnormality has occurred before a slip sheet S reaches the standby position A3.

In the first through third slip sheet transport paths r1 through r3 through which slip sheets S are transported, the portion positioned farther downstream than the standby position A3 in the transport direction (such a portion will be referred to as a "downstream portion") is constituted by the third slip sheet transport path r3. In the downstream portion, only the transporting of slip sheets S is performed. Accordingly, it is less likely that an abnormality, such as a jam of a slip sheet S, occurs in the downstream portion. In contrast, the portion positioned farther upstream than the standby position A3 in the transport direction (such a portion will be referred to as an "upstream portion") is constituted by the first through third slip sheet transport paths r1 through r3, respectively. More specifically, slip sheets S are transported through the first and second slip sheet transport paths r1 and r2. Additionally, slip sheets S are supplied to the first and second slip sheet transport paths r1 and r2 from the first and second slip sheet stacking sections 311 and 312, respectively, and a slip sheet S passes from the first or second slip sheet transport path r1 or r2 to the third slip sheet transport path r3. Accordingly, it is more likely that an abnormality, such as a jam of a slip sheet S, occurs in the upstream portion.

Thus, the standby position A3 and the slip sheet detecting sensor B2 are provided on the downstream side of the first and second slip sheet transport paths r1 and r2 where a jam of a slip sheet S is likely to occur. With this configuration, upon the occurrence of an abnormality, such as a jam of a slip sheet S, in the first or second slip sheet transport path r1 or r2, the sheet processing controller 550 is able to efficiently detect the occurrence of an abnormality of a slip sheet S which has not yet reached the standby position A3, compared with a case in which the configuration of the first exemplary embodiment is not employed.

In the first exemplary embodiment, the main controller 130 outputs information concerning the supply of the sheet P4, which is a preceding sheet, to the sheet processing controller 550 in step S103. Alternatively, the main controller 130 may output information concerning the sheet P3 which has been transported prior to the sheet P4 and the sheet P5, which is a succeeding sheet. In this case, in step S201, the sheet processing controller 550 obtains information concerning the supply of the sheet P3 input from the main controller 130. Then, in step S202, the sheet processing controller 550 stops the slip sheet S at the standby position A3 in the standby state on the basis of the information input from the main controller 130 in step S201.

In the image forming system 1 of the first exemplary embodiment, the sheet processing controller 550 determines whether an abnormality, such as a jam, has occurred before a slip sheet S reaches the standby position A3, on the basis of an output from the slip sheet detecting sensor B2 provided at the standby position A3. However, another sensor for detecting an abnormality, such as a jam of a slip sheet S, may be provided in the first or second slip sheet transport path r1 or r2, and, on the basis of an output from this sensor, the sheet processing controller 550 may determine whether an abnormality, such as a jam, has occurred before a slip sheet S reaches the standby position A3.

Second Exemplary Embodiment

A second exemplary embodiment of the present invention will be described below. The configuration of the image forming system 1 of the second exemplary embodiment is similar to that of the image forming system 1 of the first exemplary embodiment shown in FIG. 1, except that the image forming system 1 of the second exemplary embodiment does not include the slip sheet detecting sensor B2. In the second exemplary embodiment, the configurations of elements similar to those of the first exemplary embodiment are designated by like reference numerals, and a detailed explanation thereof will thus be omitted.

Figure 8:
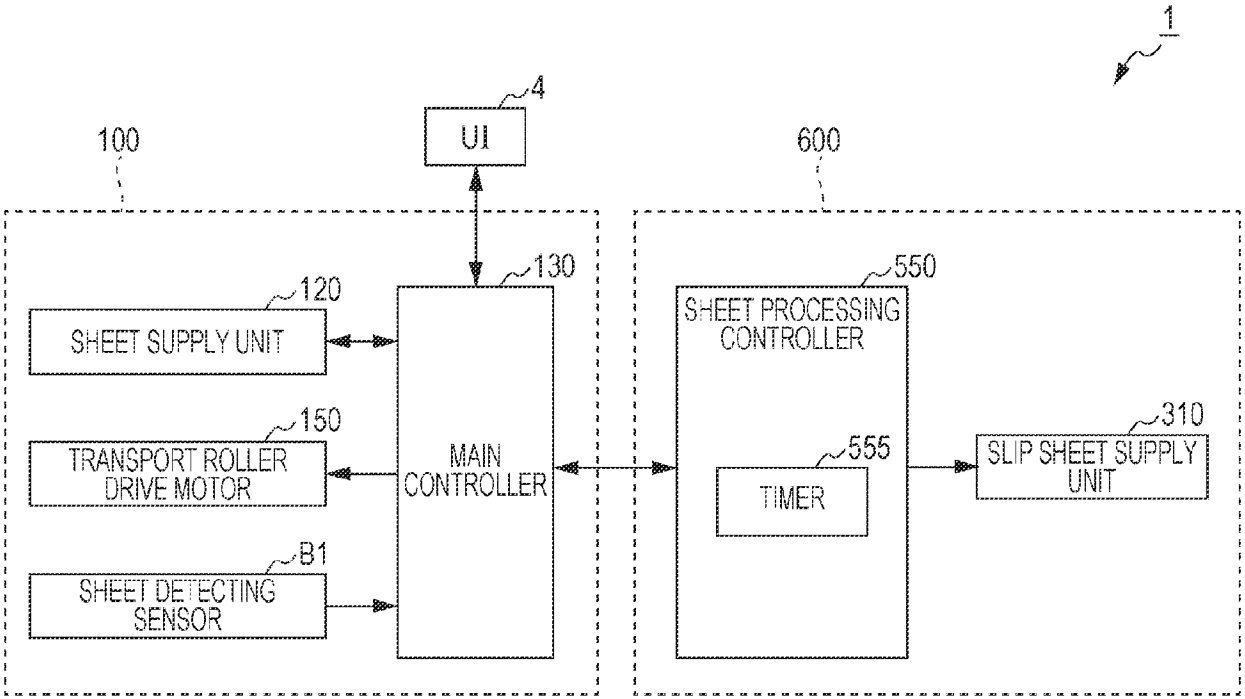
FIG. 8 illustrates a control block of an image forming system according to a second exemplary embodiment.

FIG. 8 illustrates a control block of the image forming system 1 according to the second exemplary embodiment.

In the image forming system 1, as shown in FIG. 8, as in the first exemplary embodiment, information concerning, for example, the transporting of sheets P, is output from the main controller 130 provided in the image forming apparatus 100 to the sheet processing controller 550 provided in the sheet post-processing apparatus 600. The sheet processing controller 550 controls the individual mechanisms of the sheet post-processing apparatus 600 on the basis of this information.

In the second exemplary embodiment, the sheet processing controller 550 forms a transport information obtaining unit and a memory.

Various items of information are input into the image forming apparatus 100. For example, information concerning the insertion of a slip sheet S received via the UI apparatus 4 is input into the main controller 130. Additionally, information concerning the supply of sheets P is input into the main controller 130 from the sheet supply unit 120. Information concerning the transporting of sheets P detected by the sheet detecting sensor B1 is also input into the main controller 130.

The main controller 130 then outputs information concerning the supply of sheets P input from the sheet supply unit 120 and information concerning the transporting of sheets P detected by the sheet detecting sensor B1 to the sheet processing controller 550 of the sheet post-processing apparatus 600.

On the basis of information concerning the supply of sheets P input from the sheet supply unit 120, the main controller 130 of the second exemplary embodiment assumes that a virtual slip sheet (virtual slip sheet Si) will be supplied from the sheet supply unit 120, and also outputs information concerning the virtual slip sheet Si to the sheet processing controller 550. This will be discussed in detail later.

In the sheet post-processing apparatus 600, information concerning the supply of sheets P and information concerning the transporting of sheets P are input into the sheet processing controller 550 from the main controller 130 of the image forming apparatus 100.

The sheet processing controller 550 of the second exemplary embodiment includes a timer 555 that performs counting time on the basis of information concerning a virtual slip sheet Si obtained from the main controller 130. The timer 555 is an example of a timing unit. The sheet processing controller 550 of the second exemplary embodiment also stores in advance, if a slip sheet S is supplied from the slip sheet supply unit 310, the time taken for the slip sheet S to reach the joining position A2 (slip sheet supply time t2). Then, the sheet processing controller 550 controls an operation of the slip sheet supply unit 310 on the basis of counting results obtained by the timer 555 and the slip sheet supply time t2.

Figure 9:
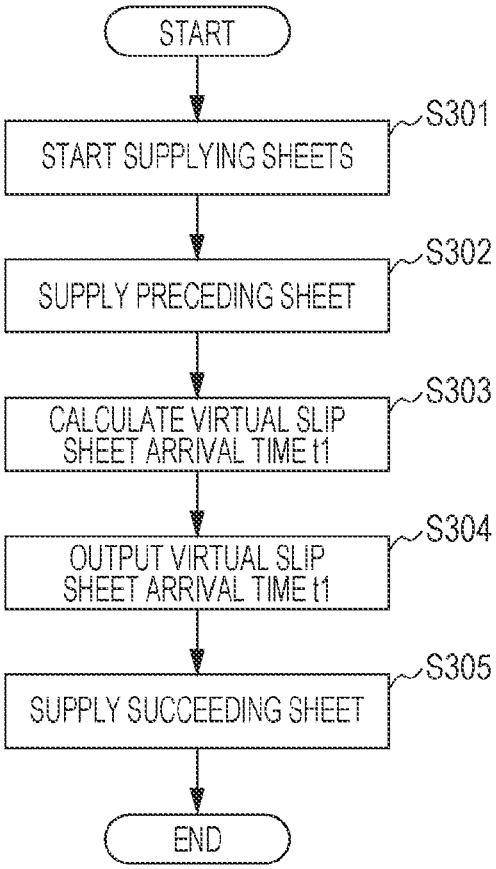
FIG. 9 is a flowchart illustrating a control operation performed by a main controller of the second exemplary embodiment.
Figure 10:
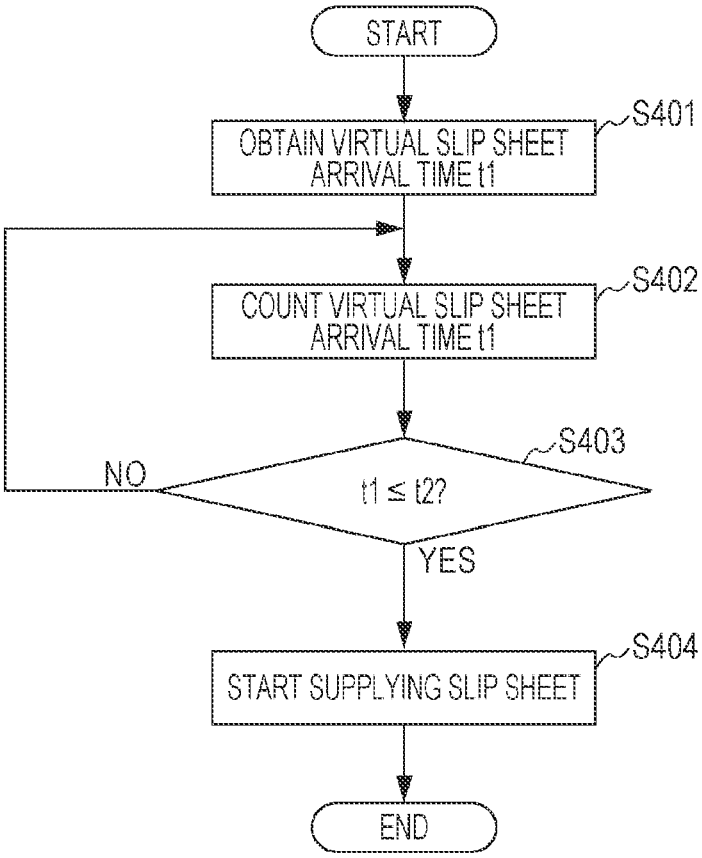
FIG. 10 is a flowchart illustrating a control operation performed by a sheet processing controller of the second exemplary embodiment.

A description will now be given, with reference to FIGS. 9 through 11D, of a procedure of slip-sheet insertion processing performed in the image forming system 1 of the second exemplary embodiment. FIG. 9 is a flowchart illustrating a control operation performed by the main controller 130 of the second exemplary embodiment. FIG. 10 is a flowchart illustrating a control operation performed by the sheet processing controller 550 of the second exemplary embodiment. FIGS. 11A through 11D illustrate slip-sheet insertion processing performed by the main controller 130 and the sheet processing controller 550 according to the second exemplary embodiment.

It is assumed that, in the example shown in FIGS. 11A through 11D, an instruction to insert a slip sheet S between sheets P4 and P5 among plural sheets P (sheets P1, P2, P3, and so on) supplied from the sheet supply unit 120 and sequentially transported has been given through the UI apparatus 4. That is, in this example, the sheet P4 is a preceding sheet, and the sheet P5 is a succeeding sheet.

In step S301, an instruction to form an image is given via the UI apparatus 4 and a start button (not shown) is pressed. Then, the main controller 130 causes the sheet supply unit 120 to start supplying sheets P. The sheet supply unit 120 sequentially supplies plural sheets P one by one to the first sheet transport path R1 under the control of the main controller 130. In the second exemplary embodiment, the plural sheets P are sequentially transported at regular spacings, except for the sheet P4 and the sheet P5 between which a slip sheet S will be inserted.

Then, in step S302, the main controller 130 causes the sheet supply unit 120 to supply a preceding sheet among the plural sheets P to the first sheet transport path R1 (see FIG. 1).

Then, in step S303, the main controller 130 assumes that a virtual slip sheet (virtual slip sheet Si, see FIGS. 11A through 11D) will be supplied from the sheet supply unit 120 to a position subsequent to the sheet P4 on the first sheet transport path R1 and will be transported up to the joining position A2. The main controller 130 then calculates a time taken for the virtual slip sheet Si to reach the joining position A2 (virtual slip sheet arrival time t1).

In step S304, the main controller 130 outputs the virtual slip sheet arrival time t1 calculated in step S303 to the sheet processing controller 550.

Then, in step S305, the main controller 130 causes the sheet supply unit 120 to supply the sheet P5, which is a succeeding sheet, to the first sheet transport path R1.

Figure 11A:
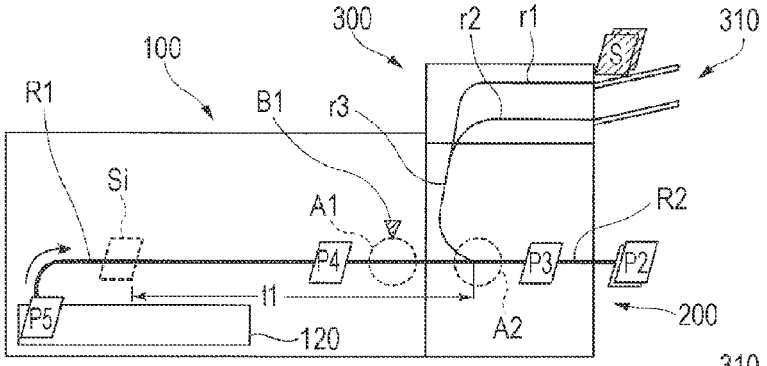
FIGS. 11A through 11D illustrate slip-sheet insertion processing performed by a main controller and a sheet processing controller according to the second exemplary embodiment.
Figure 11B:
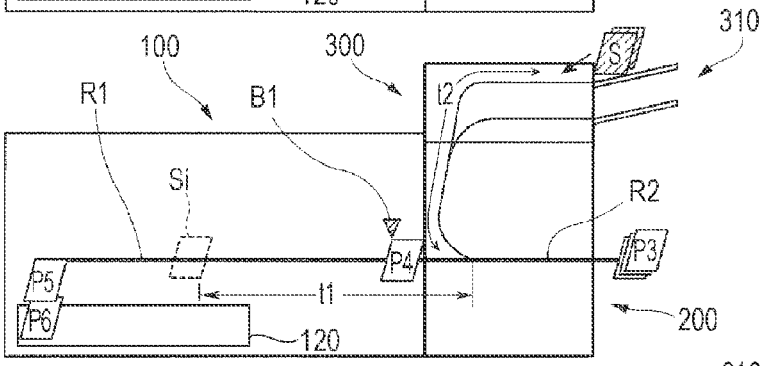

In this case, as shown in FIGS. 11A and 11B, the main controller 130 supplies the sheet P5 by leaving a gap for the virtual slip sheet Si assumed in step S303 between the sheet P5 and the sheet P4 which is being transported through the first sheet transport path R1.

The main controller 130 of the second exemplary embodiment supplies the sheet P4 and the sheet P5 so that the spacing between the sheet P4 and the virtual slip sheet Si and the spacing between the virtual slip sheet Si and the sheet P5 will be equal to the spacing between other sheets P.

In step S401, the sheet processing controller 550 obtains the virtual slip sheet arrival time t1 output from the main controller 130 in step S304.

Then, in step S402, the sheet processing controller 550 causes the timer 555 to start counting (counting down) the virtual slip sheet arrival time t1 obtained in step S401.

Then, in step S403, the sheet processing controller 550 compares the virtual slip sheet arrival time t1 counted by the timer 555 with a predetermined slip sheet supply time t2. The slip sheet supply time t2 is a time taken from when the slip sheet supply unit 310 starts supplying a slip sheet S until when the slip sheet S reaches the joining position A2.

If it is determined in step S403 that the virtual slip sheet arrival time t1 is greater than the slip sheet supply time t2 (if the result of step S403 is NO), the sheet processing controller 550 returns to step S402 in which the timer 555 continues counting the virtual slip sheet arrival time t1.

If it is determined in step S403 that the virtual slip sheet arrival time t1 is equal to or smaller than the slip sheet supply time t2 (if the result of step S403 is YES), the process proceeds to step S404. In step S404, the sheet processing controller 550 causes the slip sheet supply unit 310 to start supplying a slip sheet S.

Figure 11C:
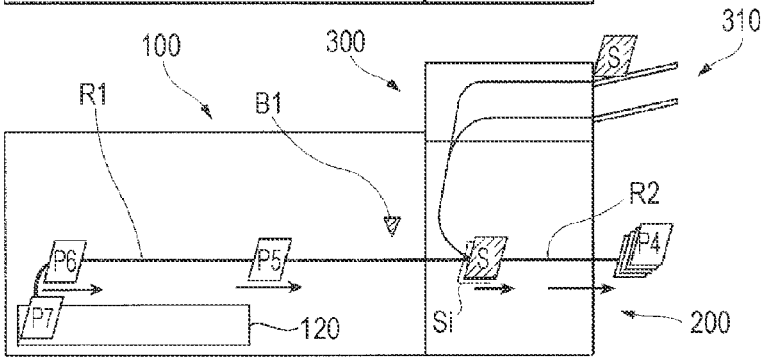
Figure 11D:
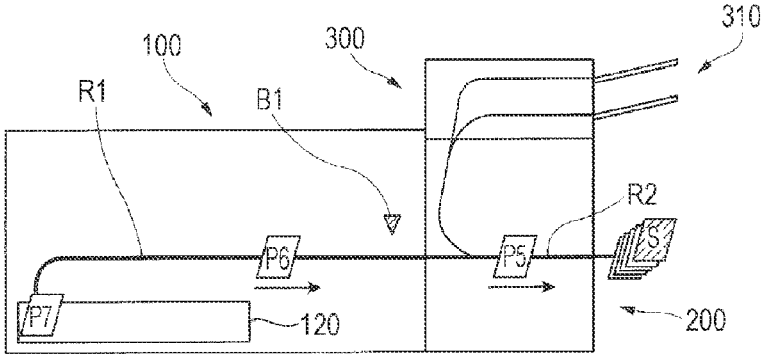

Then, the slip sheet S supplied from the slip sheet supply unit 310 is fed to the joining position A2 such that the slip sheet S matches the virtual slip sheet Si assumed by the main controller 130. That is, the slip sheet S supplied from the slip sheet supply unit 310 reaches the joining position A2, as shown in FIG. 11C, after the sheet P4, which is a preceding sheet, has passed through the joining position A2 and before the sheet P5, which is a succeeding sheet, reaches the joining position A2.

Thus, the slip sheet S supplied from the slip sheet supply unit 310 is inserted between the sheet P4 and the sheet P5.

Thereafter, in response to an instruction received by the main controller 130 from a user via the UI apparatus 4, the main controller 130 and the sheet processing controller 550 supply and transport the slip sheet S and sheets P. Then, the slip-sheet insertion processing has been completed.

As described above, in the image forming system 1 of the second exemplary embodiment, when performing processing for inserting a slip sheet S between sequentially transported plural sheets P, the main controller 130 of the image forming apparatus 100 assumes that a virtual slip sheet Si used for inserting a slip sheet S between a preceding sheet (in the second exemplary embodiment, the sheet P4) and a succeeding sheet (in the second exemplary embodiment, the sheet P5) will be transported. Then, the main controller 130 supplies the preceding sheet, and then starts supplying the succeeding sheet by leaving a gap corresponding to the virtual slip sheet Si after the preceding sheet. The main controller 130 also outputs the virtual slip sheet arrival time t1 taken for the virtual slip sheet Si to reach the joining position A2 to the sheet processing controller 550 of the sheet post-processing apparatus 600. Then, the sheet processing controller 550 causes the slip sheet supply unit 310 to start supplying a slip sheet S to the joining position A2 before the preceding sheet arrives the joining position A2, on the basis of the virtual slip sheet arrival time t1 obtained from the main controller 130 and the slip sheet supply time t2 taken for the slip sheet S to reach the joining position A2.

With this configuration, in the image forming system 1 of the second exemplary embodiment, the spacing between the preceding sheet and the slip sheet S and the spacing between the slip sheet S and the succeeding sheet do not become wide, compared with a case, as in the example of the related art shown in FIGS. 12A through 12D, in which the supply of a slip sheet S is started after a preceding sheet has passed through the joining position A2, and upon completion of supplying the slip sheet S, the supply of a succeeding sheet is started.

Thus, the total time taken to transport plural sheets P and a slip sheet S to be inserted between sheets P does not become long, and thus, the productivity of processing performed in the image forming system 1 is maintained.

Additionally, as discussed above, in the image forming system 1 of the second exemplary embodiment, the sheet processing controller 550 supplies a slip sheet S by using the slip sheet supply unit 310 on the basis of the virtual slip sheet arrival time t1 and the slip sheet supply time t2. With this configuration, the sheet processing controller 550 is able to supply a slip sheet S so that the slip sheet S may reach the joining position A2 in accordance with the time at which a virtual slip sheet Si assumed to be transported between a preceding sheet and a succeeding sheet reaches the joining position A2.

With this configuration, it is possible to reliably insert a slip sheet S between a preceding sheet and a succeeding sheet, compared with a case in which the configuration of the second exemplary embodiment is not employed. Thus, plural sheets P and slip sheets S are not output from the transport unit 200 in an order different from a predetermined order.

In the second exemplary embodiment, the main controller 130 outputs the virtual slip sheet arrival time t1 to the sheet processing controller 550, and the sheet processing controller 550 counts the virtual slip sheet arrival time t1 and thereby supplies a slip sheet S on the basis of the virtual slip sheet arrival time t1 and the slip sheet supply time t2. However, the sheet processing controller 550 may supply a slip sheet S on the basis of information other than the virtual slip sheet arrival time t1.

For example, the sheet processing controller 550 may store in advance, not only the slip sheet supply time t2, but also the time taken for a sheet P supplied by the sheet supply unit 120 to reach the joining position A2 (sheet arrival time t3), and may supply a slip sheet S on the basis of the sheet arrival time t3 and the slip sheet supply time t2.

More specifically, when the main controller 130 supplies a preceding sheet by using the sheet supply unit 120, it outputs information concerning the supply of the preceding sheet to the sheet processing controller 550. Then, the sheet processing controller 550 causes the timer 555 to count (count down) the sheet arrival time t3, starting from the time at which information concerning the supply of the preceding sheet has been obtained. Then, when the sheet arrival time t3 counted by the timer 555 becomes smaller than the slip sheet supply time t2 ($t3<t2$), the sheet processing controller 550 causes the slip sheet supply unit 310 to start supplying a slip sheet S.

With this arrangement, after the forward end of the preceding sheet has reached the joining position A2 and the preceding sheet has been transported farther downward than the joining position A2, the slip sheet S reaches the joining position A2. It is thus possible to insert the slip sheet S after the preceding sheet and between the preceding sheet and the succeeding sheet.

The image forming system 1 of the first exemplary embodiment shown in FIGS. 1 and 2 and the image forming system 1 of the second exemplary embodiment shown in FIG. 8 each include the image forming apparatus 100 and the sheet post-processing apparatus 600. The sheet post-processing apparatus 600 includes the transport unit 200, the interposer 300, the stacker unit 400, and the finisher unit 500. However, the image forming system 1 is not restricted to the configuration shown in FIG. 1.

The image forming system 1 may be configured in any manner, as long as it includes the image forming apparatus 100 which forms images on plural sheets P sequentially transported at certain spacings, the transport unit 200 which transports the plural sheets P output from the image forming apparatus 100, and the interposer 300 which inserts a slip sheet S between plural sheets P transported by the transport unit 200. For example, another processing unit which performs processing on sheets P may be disposed between the image forming apparatus 100 and the transport unit 200. Moreover, it is not necessary to connect the stacker unit 400 or the finisher unit 500 to the downstream side of the transport unit 200, and instead, plural sheets P and slip sheets S may be directly discharged from the transport unit 200.

In the first and second exemplary embodiments, the image forming apparatus 100 includes the sheet supply unit 120, and plural sheets P supplied from the sheet supply unit 120 are sequentially transported in the image forming system 1. However, a sheet supply unit which sequentially supplies plural sheets P may be provided separately from the image forming apparatus 100, and plural sheets P supplied from the sheet supply unit may be sequentially transported in the image forming apparatus 100 and the sheet post-processing apparatus 600.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

an image forming apparatus configured to form images on a plurality of sheets which are sequentially transported with a spacing between the plurality of sheets and that outputs the plurality of sheets; and a sheet transport apparatus comprising a transport section configured to receive the plurality of sheets sequentially transported and output from the image forming apparatus and transport the plurality of sheets farther downstream in a transport direction and configured to supply a different type of sheet from a different-type-of-sheet supply device, configure to insert the different type of sheet into a spacing provided between the plurality of sheets which are transported in the transport section, and configured to transport the different type of sheet and the plurality of sheets, the sheet transport apparatus comprising:

a transport information obtaining unit configured to obtain information concerning transporting of sheets from the image forming apparatus, a timing unit configured to count a time concerning transporting of sheets on the basis of the information concerning transporting of sheets obtained by the transport information obtaining unit, a different-type-of-sheet supply unit is configured to start supplying the different type of sheet from the different-type-of-sheet supply device before the spacing into which the different type of sheet will be inserted reaches the transport section, on the basis of the time concerning transporting of sheets counted by the timing unit, and a memory configured to store in advance a different-type-of-sheet supply time taken for the different type of sheet supplied from the different-type-of-sheet supply device by the different-type-of-sheet supply unit to reach the transport section, wherein:

the timing unit is configured to count a spacing arrival time taken for the spacing into which the different type of sheet will be inserted to reach the transport section, on the basis of the information concerning transporting of sheets obtained by the transport information obtaining unit; and the different-type-of-sheet supply unit is configured to start supplying the different type of sheet when the spacing arrival time counted by the timing unit becomes equal to or smaller than the different-type-of-sheet supply time stored in the memory.

2. A sheet transport apparatus comprising:

a transport section configured to receive a plurality of sheets from an image forming apparatus configured to form images on a plurality of sheets sequentially transported with a spacing between each of the plurality of sheets and configured to output the plurality of sheets, the transport section configured to transport the received plurality of sheets farther downstream in a transport direction;

a transport information obtaining unit configured to obtain information concerning transporting of sheets from the image forming apparatus;

a timing unit configured to count a time concerning transporting of sheets on the basis of the information concerning transporting of sheets obtained by the transport information obtaining unit; a different-type-of-sheet supply unit configured to supply a different type of sheet from a different-type-of-sheet supply device and configured to insert the different type of sheet into a spacing provided between the plurality of sheets which are transported in the transport section, and a memory configured to store in advance a different-type-of-sheet supply time taken for the different type of sheet supplied from the different-type-of-sheet supply device by the different-type-of-sheet supply unit to reach the transport section, wherein the different-type-of-sheet supply unit is configured to start supplying the different type of sheet from the different-type-of-sheet supply device before the spacing into which the different type of sheet will be inserted reaches the transport section, on the basis of the time concerning transporting of sheets counted by the timing unit, wherein:

the timing unit is configured to count a spacing arrival time taken for the spacing into which the different type of sheet will be inserted to reach the transport section, on the basis of the information concerning transporting of sheets obtained by the transport information obtaining unit; and the different-type-of-sheet supply unit is configured to start supplying the different type of sheet when the spacing arrival time counted by the timing unit becomes equal to or smaller than the different-type-of-sheet supply time stored in the memory.

* * * * *